US005722373A

United States Patent [19]

Paul et al.

[11] Patent Number: 5,722,373

[45] Date of Patent: Mar. 3, 1998

[54] FUEL INJECTOR SYSTEM WITH FEED-BACK CONTROL

[76] Inventors: Marius A. Paul; Ana Paul, both of 1120 E. Elm Ave., Fullerton, Calif. 92631

[21] Appl. No.: 556,467

[22] Filed: Nov. 8, 1995

Related U.S. Application Data

[63] Continuation-in-part of Ser. No. 294,432, Aug. 23, 1994, abandoned, which is a continuation of Ser. No. 24,186, Feb. 26, 1993, abandoned.

[51] Int. Cl.[6] ..... F02M 7/00

[52] U.S. Cl. ..... 125/446; 123/357; 123/501

[58] Field of Search ..... 123/446, 447, 123/500, 501, 357, 458, 494

[56] References Cited

U.S. PATENT DOCUMENTS

| | | | |
|---|---|---|---|
| Re. 33,270 | 7/1990 | Beck | 123/446 |
| 4,359,032 | 11/1982 | Ohie | 123/458 |
| 4,372,266 | 2/1983 | Hiyama | 123/357 |
| 4,462,368 | 7/1984 | Funada | 123/501 |
| 5,101,785 | 4/1992 | Ito | 123/357 |
| 5,176,115 | 1/1993 | Champion | 123/446 |

*Primary Examiner*—Carl S. Miller
*Attorney, Agent, or Firm*—Bielen, Peterson & Lampe

[57] ABSTRACT

A fuel injector system for a high speed, high pressure engine, the fuel injector system including a pressurized fuel supply, a fuel distributor with an electronically controlled and electronically monitored fuel metering mechanism and a fuel injector with an electronically monitored needle valve wherein the fuel system includes an electronic control module to receive signals from the positioning of the needle valve and the signals from the fuel metering mechanism for analysis and electronic regulation of the metering system to effect injection according to optimum operating conditions.

13 Claims, 22 Drawing Sheets

FUEL INJECTOR SYSTEM WITH FEED-BACK CONTROL

BACKGROUND OF THE INVENTION

This application is a continuation-in-part of our application, Ser. No. 08/294,432, filed 23 Aug. 1994 of the same title, now abandoned, which is a continuation of abandoned application Ser. No. 08/024,186 filed 26 Feb. 1993.

This invention relates to high pressure fuel injectors and injector control systems. The various embodiments of fuel injector control systems disclosed in this specification are adaptable to high pressure fuel injectors which are the subject matter of earlier applications of the inventors herein. Certain embodiments and features may also be utilized in other low pressure and medium pressure fuel injectors designed and manufactured by others. The fuel injectors and control systems described herein are intended to be designed as an integrated unit but may be constructed as discrete components allowing adaptation of the control systems to existing injectors. The control features disclosed herein have particular applicability to high pressure fuel injectors where precise control of the fuel supply is necessary to prevent over or under supply of fuel during variable operating conditions. At high pressure, the fuel regulation must be more precisely controlled to prevent inappropriate timing or duration of the fuel injection pulse, which under high pressure, magnify fuel waste and emission problems.

In developing fuel injectors for high pressure, high speed engines, fuel economy and low emissions are important considerations. Accurate timing and metering of fuel is essential to achieve these goals. Prior art systems have inherent mechanical design limitations that render them unworkable for high pressure systems. In many such systems, back pressures and reflected hydraulic pressure waves from a common supply rail prevent the injector needle from firm seating and instantaneous cutoff once the fuel delivery cycle has been completed. This results in a lag in the fuel shut-off and leakage of additional fuel into the combustion chamber which is added in an inappropriate time during the engine cycle. This results in smoke from incomplete combustion and wasting of fuel.

In a high pressure engine, where the combustion chamber is designed for high pressure, high temperature combustion, injection systems must be designed to inject fuel at peak pressures at 2000 to 4000 atmospheres. The fuel must be injected in an appropriate manner to ensure that the actual fuel delivery coincides with the intended fuel profile. This is particularly important in electronic fuel delivery systems where the operating conditions are monitored electronically and fuel is metered according to engine performance and operator demand under central control by a preprogrammed computer control system.

In certain prior art systems having an electronic delivery system, a control system monitors engine operating conditions and operator demands. Input from multiple sensors and operator control devices are processed in a computer control processor, which in turn provides an output signal for regulating the fuel injector delivery system.

In such systems, there is no direct feedback loop to determine, if in fact the calculated fuel delivery is in fact delivered in the quantity, duration, cycle, sequence and delivery profile calculated. Adjustments are provided only through the resultant response of the engine operation as compounded in complexity by the demand changes of the operator through the operator control devices such as accelerator, gearshift, or turbo charger activation.

The lag in time and lack of precision in this method is not sufficient to provide the immediate adjustments required to avoid real-time supply irregularities and resultant loss of power or waste of fuel. Furthermore, since the engine performance is generally monitored as a whole, discrimination as to the performance of discrete injectors in a multi-injector engine is not possible.

Each injector has unique performance characteristics with mechanical tolerance differences, different electronic response, bore variations in hydraulic passages and other factors that result in a different needle valve response which ultimately controls the injection spray profile.

Under rotation changes or differing load conditions a complex set of variables renders even the most sophisticated conventional electronic control system incapable of close regulation of the injection process.

In multiple cylinder engines or in engines having one or more cylinders with multiple fuel injectors, it is customary to include a rail supply, which is essentially a high pressure fuel injector manifold, situated between the highest pressure, common, fuel injector pump and the fuel injectors. The rail supply holds a volume of high pressure fuel and operates as a surge control for modulating or buffering the periodic pulsing of the injectors. However, the high frequency pulsing of fuel released into the cylinders results in reflected pressure waves in the rail supply and other hydraulic components that appears to inhibit the fuel injector needle valve from seating and thereby fully closing the discharge orifices of the injector nozzle. In such a situation the actual fuel pulse has a long tail or injection dribble which is untimely to the operating cycle of the engine. Injection tail or leak results in incomplete complete combustion and pollution in the form of sooty exhaust or high carbon smoke.

In order to obtain precision in multi-injector engines, each injector must have means for controlling its injection process, such that the actual characteristics of the pulsed spray is uniform with the other injectors, despite unique performance characteristics associated with that particular injector.

The injection process must be correctable over time, such that certain reference performance characteristics are maintained as individual injectors age and alter tolerances.

Additionally, different grades or types of fuel may require specialized adjustment in operation or special design in the delivery system. For example, where alcohol or gasoline is used instead of diesel fuel, the inherent lubricating feature of diesel fuel cannot be relied upon to assist in lubricating spool valves or other displaceable parts under high pressure. Furthermore, to inhibit piston knock and to reduce nitrogen oxides resulting from abrupt high temperature combustions, certain embodiments provide a stepped fuel delivery, which can be regulated according to operating perimeters and type of fuel combusted. These and other problems and challenges have led to the various embodiments devised and described in greater detail herein in the Detailed Description of the Preferred Embodiments.

SUMMARY OF THE INVENTION

The high pressure fuel injectors and control systems of this invention incorporate a feedback control that is directly dependent on operating parameters of the fuel injector itself, as differentiated from the conventional dependency on the operating parameters of the engine as a whole. In particular, key to determination of the actual timing and profile of an injection spray is the position of the needle valve within the injector. When coupled with other direct operating parameters of the injector, for example fuel pressure, the characteristics of the jet spray can be determined in real-time by monitoring needle valve position to provide an immediate quantitative measure for a feedback loop.

In a high-pressure, high-speed engine, undergoing changing loads and operator demands, conventional control circuits that depend on engine performance are too slow to efficiently correct the operation of the fuel injectors. Furthermore, because correction of the operation of an injector is customarily accomplished through adjustment of the actuator causing displacement of the needle valve, there is no means of adequately differentiating the operation of one actuator in a multi-injector engine from another using the general operating parameters of the engine. Also, there is no assurance that a calculated change in the actuator parameter will effect the desired response in needle valve.

In certain embodiments described, additional regulation of the operating components of the fuel injector is provided by monitoring the position and response of the spool valves that route this high pressure injection fluid to the discharge jet. By mapping the operating characteristics of each injector to the control system processor, each injector will be provided with its own reference map for discrete operational control of each injector from feedback data particularized for that injector. This flexibility allows a loosening of manufacturing tolerances, which for ultra high pressure components must be extremely tight as minor tolerance variations under high hydraulic pressure, without compensation, can result in drastically different results. By mapping a reference operating profile for a particular injector, the system control components can be used to "standardize" a group of injectors and dynamically make adjustments for a particular injector by reference and comparison to its discrete map. In this manner, mechanical and hydraulic tolerance variations are forgiven by utilizing the system control to compensate for unique performance differences in discrete injectors. The adjusted injectors have a performance uniformity and corrections to the performance of the injectors during operation is tailored to each injector according to its own reference map.

Using certain mechano-hydraulic techniques and features as described in our previous application, Ser. No. 840,839, entitled, *Fuel Injector System*, which issued from a continuation application as U.S. Pat. No. 5,263,645 on Nov. 23, 1993, to assure absolute and definitive opening and closing of the needle valve under high pressure conditions, combined with the feedback and control techniques and features described herein, engine operation can be truly optimized. The direct monitoring of injector operation together with added monitoring of overall engine operation, including exhaust composition, provide the combined base data for instantaneous correction for adjustment to changed conditions and/or optimized performance.

These and other features will be described in the detailed consideration of the various embodiments disclosed that provide exemplars of the different-types of systems that incorporate to features of this invention.

DETAILED DESCRIPTION OF THE PREFERRED EMBODIMENTS

Figure 1A:
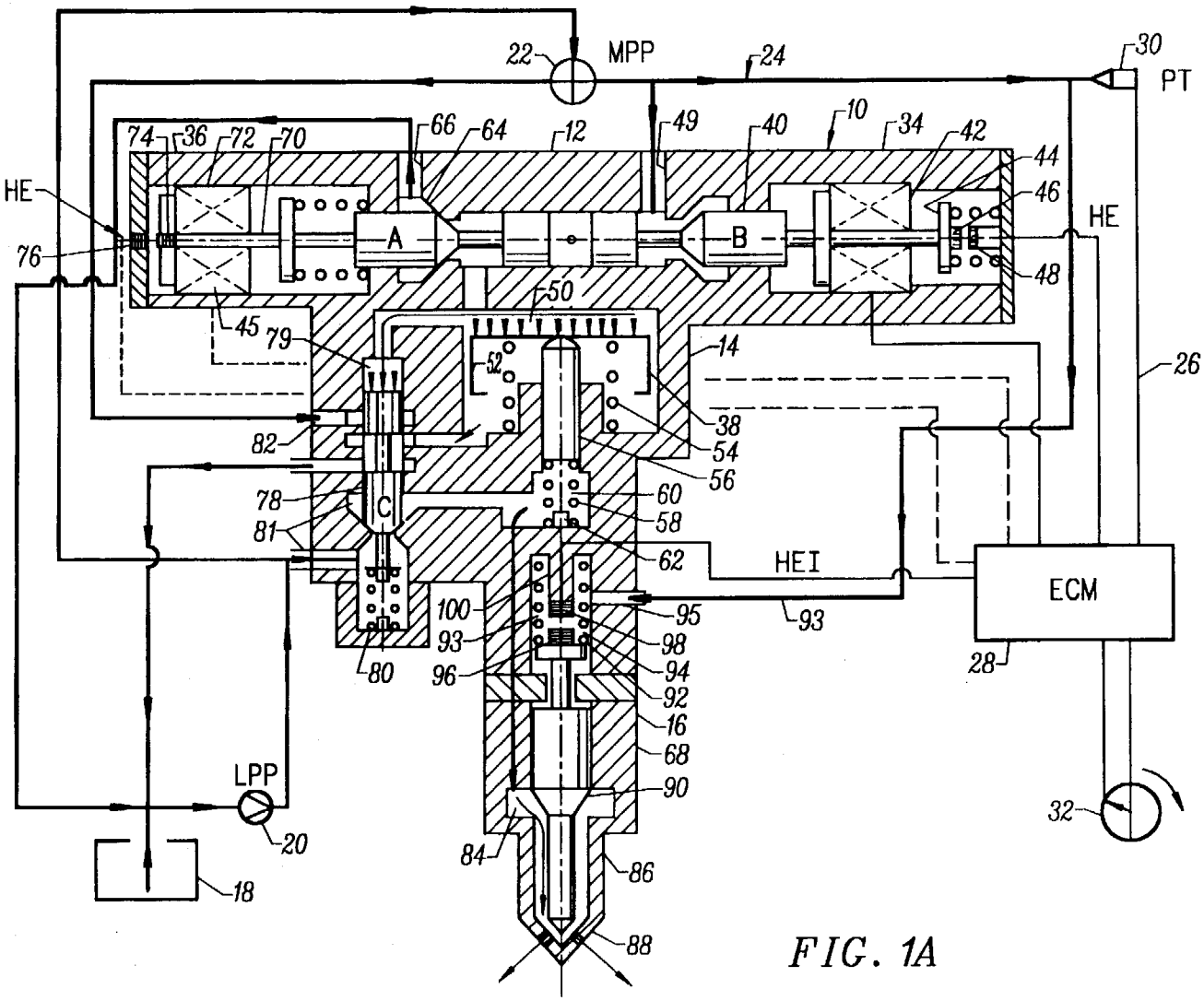
FIG. 1A is a cross-sectional view, partially in schematic, of a first embodiment of a fuel injector system.

Referring to FIG. 1A, one representative example of the high pressure fuel injector and injector control system is shown. In FIG. A, a fuel injector unit 10 has a unitary construction of three primary components, a distributor 12, a pressure amplifier 14 and an injector 16. The fuel injector unit 10 is shown in cross-section and is interconnected with auxiliary supply and control components shown schematically. Included among the auxiliary control components is a liquid fuel reservoir 18, a low pressure supply pump 20, a medium pressure booster pump 22 and a network of hydraulic conduit 24 for supply and return of the liquid fuel that is utilized both as a hydraulic medium and a fuel medium.

In addition, an electronic control network 26 interconnects an electronic control module 28, which is essentially a dedicated microprocessor and electric power regulator. The electronic control module 28 connects to both actuators and sensors within the fuel injector unit 10, and, to external components including a pressure transducer 30 for monitoring the delivery pressure of the medium pressure pump and an encoder 32 for synchronizing the operating cycle of the fuel injectors to the fixed cycle of the engine (not shown).

The distributor 12 is connected to the pressure amplifier 14 and selectively connects a supply of pressurized fuel from the medium pressure pump 22 to a differential piston assembly 38 within the pressure amplifier 14. The distributor 12 meters the supply of fuel by displacement of a spool-poppet valve 40 actuated by a solenoid assembly 42 that is electronically controlled by the electronic control module 28. The spool-poppet valve 40 has an extension 44 that forms in part the displaceable core of the solenoid 45 and terminates in a linear transducer element 46 having a stationary counterpart 48 which, by the Hall effect transmits a signal relative to the displacement of the extension 44 to the electronic control module 28. Upon activation of the solenoid 45 and retraction of the extension 44 and the connected poppet valve 40, an open passage is provided for the medium pressure fuel to pass through an intake 49 to a chamber 50 having a wide-area floating piston 52 in contact with a compression spring 54, and a small area plunger-piston 56 for magnification of the pressure within a fuel delivery chamber 58. A small diameter compression spring 60 in the fuel chamber 58 maintains the contact between the plunger piston 56 and the larger floating piston 52. The compression spring 60 seats in the fuel delivery chamber 58 on a boss 62. Medium pressure fuel acting as a hydraulic fluid enters the amplifier chamber 50, while a return spool-sprocket valve 64 is maintained in a closed position to block an escape passage 66 that returns fuel to the reservoir 18 for recycling by the low pressure pump 20. As the chamber 50 fills with fluid and displaces the floating piston 52, the plunger piston 56 is similarly displaced driving any fluid in the fluid delivery chamber 58 under magnified pressure to the discharge nozzle 68 of the fuel injector 16.

The spool-poppet valve 64 that releases the fluid from the distributor chamber 50 is actuated in a similar manner as the supply valve 40. The spool-poppet valve 64 includes an extension stem 70 that functions as the core for an actuator solenoid 72 and has on its distal end a transducer element 74 that cooperates with a fixed transducer 76, which by the Hall effect, generates a signal indicative of the displacement of the displaceable spool-poppet valve 64.

The distributor chamber 50 also communicates with a slide valve chamber 79, wherein a sliding spool valve 78 is displaceable on pressurization of the distributor chamber 50 to allow any fluid behind the floating piston 52 be displaced to the reservoir 18. Similarly, to prevent a vacuum from being generated behind the floating piston and in the pressure fuel delivery chamber 58 upon return of the floating piston 52 and the plunger piston 56. The spool valve 78 displaces in the opposite direction under force of a compression spring 80. Fluid from the low pressure pump 20 recharges the fuel delivery chamber 58. To improve the response time of the floating piston 52 in returning to a pre-stroke position, the spool valve 78 is displaced by the spring 80 when the spool-poppet valve 64 is hydraulically connected to the return passage 66. A passage 82 communicates with the medium pressure pump 22 allowing by-pass of fluid to the backside of the floating piston 52 in the pressure amplifier chamber 50.

The injector nozzle 68 has a discharge tip 86 with discharge orifices 88 that allow pressurized fuel to be sprayed from the fuel injector unit upon displacement of a needle valve 90. The needle valve 90 is displaced hydraulically by the introduction of high pressure fuel from the fuel delivery chamber 58. The high pressure of the fuel delivered is developed upon displacement of the plunger piston 56 and overcomes a compression spring 92 and back pressure from a feed line 93 connected to the medium pressure pump 22. The feed line 93 supplies a chamber 94 behind the needle valve 90 to allow for firm seating to the needle valve 90, once the high pressure fluid from the fluid delivery chamber 62 ceases. Again, for determination of the position of the needle valve 90, a transducer element 96 on the distal end of the needle valve coacts with a transducer element 98 on a stationary post 100 in the chamber. These transducer elements form a Hall effect transducer, which is the type generally employed within the fuel injector units of this specification.

Figure 1B:
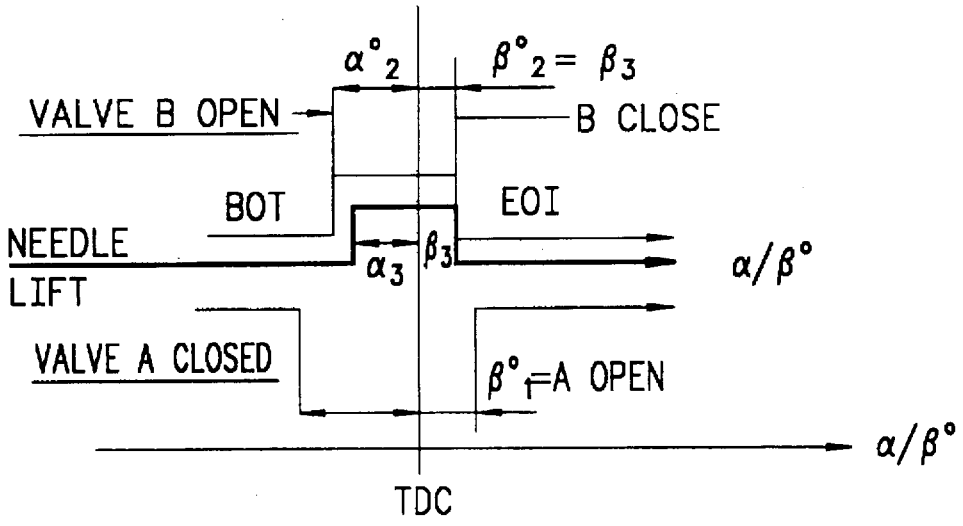
FIG. 1B is a schematic diagram of the phase operation of the injector system of FIG. 1A.

The fuel injector 10 of FIG. 1A is shown in a configuration that is in the first stages of injection. The interaction and operation of the components may be understood by reference to the schematic phase diagram of FIG. 1B. As shown in FIG. 1B, the component operation is depicted with reference to the reference line at which a piston in an associated engine is at top dead center (TDC).

In phase 1, spool-poppet valve 64, (valve A) is closed at $\alpha 1°$ before the top dead center position, thereby sealing the passage 66 from the pressure amplifier. At angle $\alpha 2°$ before top dead center, spool-poppet valve 40 (valve B) opens allowing the pressurized fuel supplied by the medium pressure pump 22 to be delivered to the amplifier chamber 50 to actuate the floating piston 52 and the pressure multiplying plunger piston 56 while at the same time displacing spool valve 78 to allow fluid to be displaced from behind the floating piston 52.

In phase 2, the beginning of injection (BOI) occurs at $\alpha 3°$ before TDC as a result of the high pressure pulse supplied from the fuel delivery chamber 58 to the needle valve plenum 84 forcing retraction of the needle valve 90 against the compression spring 92 exposing the orifices 88 and thereby allowing discharge of a fuel spray through the orifices 88, as schematically depicted in FIG. 1A.

In phase 3, the end of injection (EOI) occurs at $\beta 3°$ and is initiated by the closing of the valve 40 (valve B) blocking the connection with the passage 49 to the medium pressure pump thereby halting displacement of the floating piston 52 and connected plunger piston 56. This halts any further flow of fuel from the delivery chamber 58 to the plenum 84. Also, in phase 3 at $\beta 3°$, spool-poppet valve 64 opens allowing relief of the pressure in the circuit line 66 such that the pressure supply to the backing chamber 94 for the needle valve 90 through passage 93, coacts with the compression spring 92 to immediately return the needle valve 90 to its seating position against the nozzle tip 86, thereby blocking the orifices 88 and abruptly and firmly stopping the injection.

In phase 4, valve 64 (valve A) is opened allowing the compression springs 54 and 60 to return the pistons 52 and 56 to return to their original position. The spool valve 78 also returns to a new position under force of the spring 80 which allows the pressure fluid supply through passage 82 to be admitted to the backside of the floating piston 52 to assist in the return of the system to the start state.

As noted, the injector is provided with a needle lift transducer 93 with a stationary inductor element 96 and a moveable magnet element 98, which continually sends data relating to the needle position to the electronic control module 28 such that the initiation α3° and termination β3° of injection can be compared with the map data for the specific load and rotation conditions of the engine. Any difference is immediately detected and corrected by changing the timing of the solenoid valves 40 and 64 which are also provided with transducers elements 44 and 46 and 74 and 76 to provide real-time data of the actual positioning of the valves for corrective adjustment to the opening and shutting of the needle valve 90.

The sharp and instantaneous cut-off of pressure to the needle valve plenum is caused by opening of the spool valve 78 providing communication to the low pressure passage 81. The low pressure passage remains open for the process of induction of a new charge of fuel to the fuel delivery chamber 58. Induction of fuel occurs during the approximately 320° pre-injection phase of the cycle of operation in two-cycle engines, or the more than 680° rotation cycle for four-cycle engines. The substantial periodic induction time for a new charge of fuel allows complete recharge to occur even under high speed operating conditions.

Figure 2B:
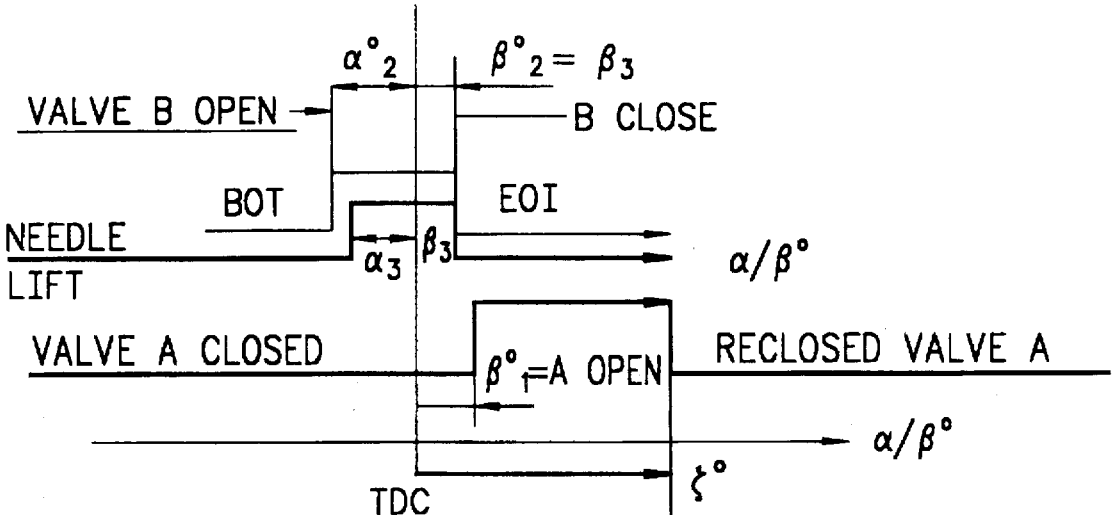
FIG. 2B is a schematic diagram of the phase operation of the fuel injector system of FIG. 2A.
Figure 2A:
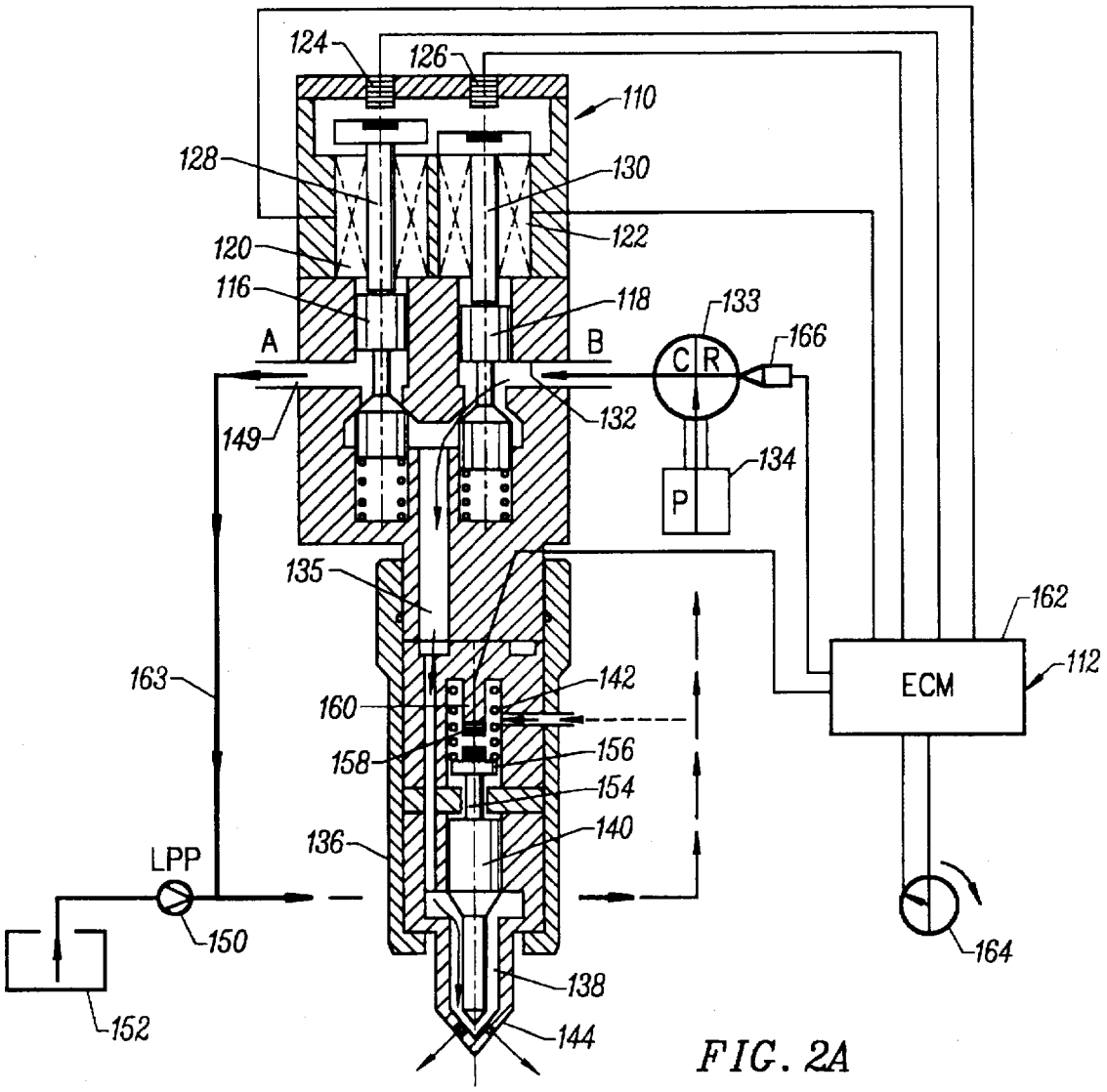
FIG. 2A is a cross-sectional view, partially schematic, of a second embodiment of a fuel injector system.

Referring now to FIG. 2A, a medium pressure fuel injector unit 110 is shown together with an injector control system 112. The fuel injector unit 110 includes a distributor component 114 with independently operated spool-poppet valves 116 and 118 actuated by solenoids 120 and 122 with Hall-effect transducers 124 and 126 that sense the position of the solenoid cores 128 and 130. The poppet-spool valve 118 allows communication of an inlet passage 132 from a common rail 133 supplied fuel by a medium pressure pump 134. The fuel is led through a feed channel 135 to the injector nozzle 136 when the solenoid 122 is activated. Medium pressure fuel is directed to the plenum 138 in the injector nozzle and the pressure of the fuel 136 forces retraction of a needle valve 140 against a compression spring 142 allowing a fuel spray to be emitted from orifices 144.

Similarly, when the fuel-poppet valve 116 is actuated the higher pressure of fuel in the plenum 138 is relieved and passes through a relief passage 148 to the supply line of a low pressure pump 150 that delivers fuel from a reservoir 152 to the medium pressure pump 134.

The needle valve 140 has an extension 154 having a transducer 156 that coacts with a transducer 158 on the end of a spring post 160 for return spring 161 to provide a position signal to an electronic control module 162 that is the central component of the injector control system 112. The position signal allows real-time determination of the precise position of the needle valve 140.

The electronic control module 162 processes data from the transducers 124 and 126 that are associated with the positioning of valves 116 and 118 to enable electronic control of the solenoids 120 and 122 which are also powered under control of the electronic control module. The electronic control module 112 processes this data together with the position of the engine crank shaft (not shown) as detected by the end coder 164. Other operating parameters are factored by the control module such as pump pressure as detected by the pressure sensor 166 at the common rail 133, and exhaust composition by exhaust sensors (not shown).

The sequential operation of the injection system is described with reference to the schematic diagram of FIG. 2B. In phase 1, prior to initiation of the injection sequence, the solenoid valve 116 (valve A) is closed sealing the relief passage 148. In phase 2, the injection process begins by opening the valve 118 at α2° allowing fluid to be admitted through the inlet passage 132 from the common rail 133. The fluid is routed through internal channels 135 to the plenum 138 of the injector nozzle 136.

At α3°, the injector needle valve 140 reacts to the pressure of inducted fluid by retracting from the discharge orifices 144, initiating the actual spray. Needle displacement is tracked by the sensing transducer 158 and a signal is sent to the electronic control module 162.

In phase 3, the end of injection is initiated by closing the solenoid operated valve 118 at β2° which returns the needle valve 140 by spring action and the low pressure fluid in the backing chamber. The needle valve displacement signals the electronic control module to open.

In phase 4, pressure is relieved by opening the valve 116 (valve A) at β1° which is shortly after the valve 118 (valve B) is closed. Any fluid that passes the relief passage 148 is returned to the low pressure line 163 meeting the booster pump 134.

In a manner similar to that of the embodiment in FIG. 1, the injection system acts with a close, closed loop control in which the actual position of the needle valve is correlated with the operating parameter map stored in the electronic control module. Adjustments for optimum operation can be effected through control of the solenoids that control the induction valve and relief valve. In a multi-cylinder engine where a plurality of injector units are coordinated, the discrete operation of each injector allows for coordinated operation of the multiple injectors with a real-time, feedback control.

Figure 3A:
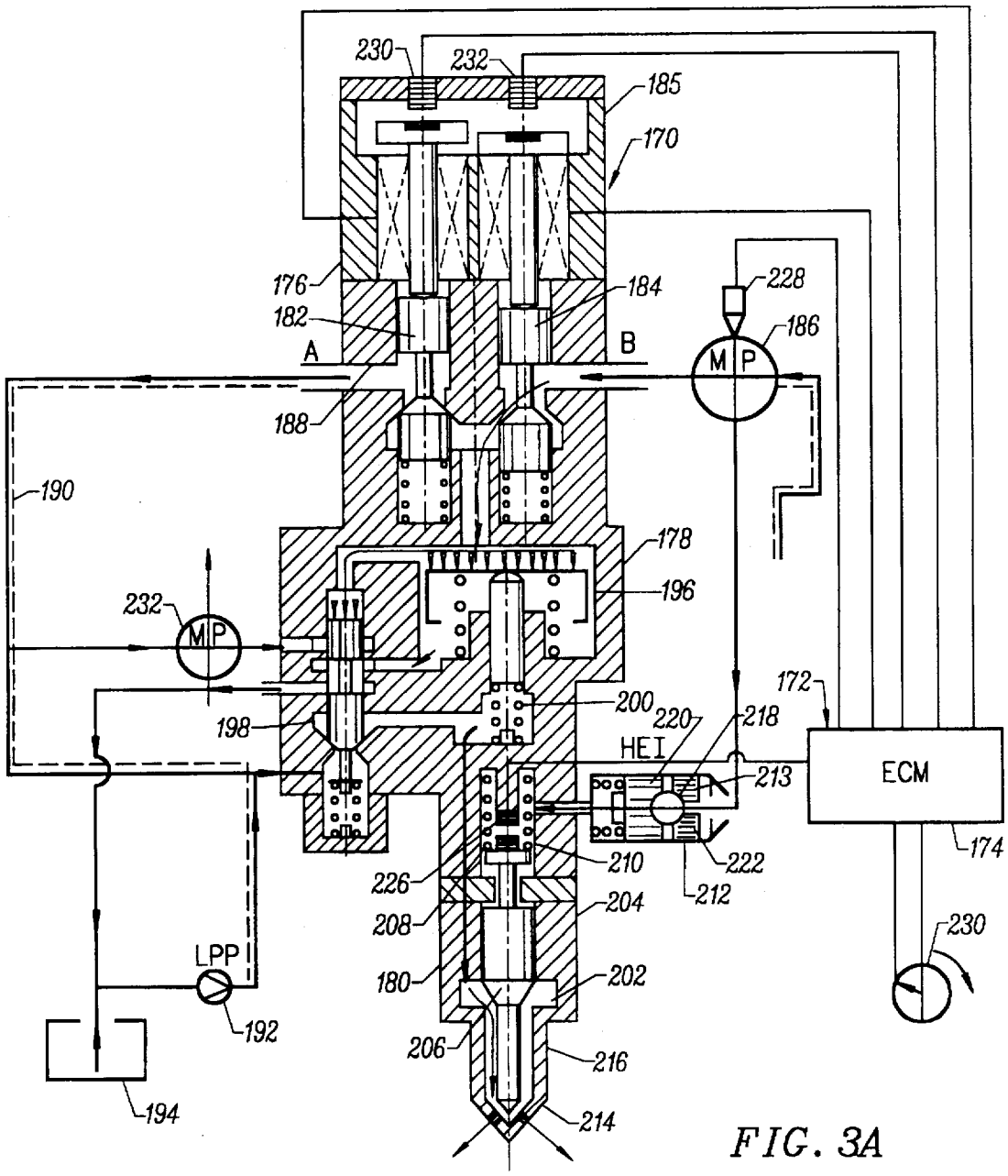
FIG. 3A is a cross-sectional view, partially in schematic, of a third embodiment of a fuel injector system.

Referring now to FIG. 3A, a fuel injector unit 170 is shown in conjunction with a control system 172 having an electronic control module 174. The fuel injector unit includes a distributor 176 coupled to a pressure amplifier 178 which in turn is coupled to an injector 180.

The distributor 176 includes electronic valve assemblies 182 and 184 of the type previously described that are actuated by a dual solenoid assembly 185. The value assemblies 182 and 184 regulate flow of fuel from a medium pressure pump 186 to the pressure amplifier 178, and relief of the developed pressure through relief passage 188. Fluid that is relieved through passage 188 returns to the low pressure line 190 supplied by the low pressure pump 192 which draws fuel from the reservoir 194.

The pressure amplifier 178 includes a pressure-multiplier, piston assembly 196 that is similar in construction to that previously described with an associated spool-poppet valve 198 for admission and relief of low pressure fuel from the low pressure pump 192 to a fuel delivery chamber 200 for induction into the plenum 202 of the injector nozzle 204. The spool-poppet valve 198 is displaced by the medium pressure in the piston assembly 196 and as auxiliary function allows periodic relief of pressurized fluid from the piston assembly during activation. The high pressure pulse of fuel delivered to the plenum 202 causes a needle valve 206 to retract against a compression spring 208 in a backing chamber 210 with a combination bleed and check valve 212. The valve has a restricted calibrated orifice 213 which controls the rate of relief of the reactant pressure in the backing chamber 210 which in turn controls the rate of the needle valve retraction, and thereby controls the profile of the injection spray through the discharge orifices 214 at the nozzle tip 216. The pressure relief valve operates in a customary manner with a ball 218 on a spring loaded seat 220 allowing unrestricted influx of fuel from the medium pressure pump 186 with a stationary check ball seat 222 having the bypass orifice 213 in the check seat 222 that allows fluid under pressure exceeding the pump pressure, restricted passage from the backing chamber 210.

The sequence of operation is described with reference to the schematic diagram of FIG. 3B.

In phase 1, the induction valve (valve A) of the electronic valve assembly 182 remains closed when at α2° when the induction valve assembly 184 is activated opening the induction valve (valve B) allowing fuel under pressure to be routed to the piston assembly 196 of the pressure amplifier 178. Pressurized fuel is also routed to the spool-poppet valve 198 which is displaced allowing trapped fluid in the piston assembly 196 to escape to the reservoir 194.

In phase 2, the beginning of the injection process proceeds by fuel trapped in the fuel delivery chamber 200 being pulsed to the plenum 202 under multiplied pressure generated by the piston assembly 196 forcing retraction of the needle valve 206 and bleeding of fluid in the backing chamber 210 through the control valve 218. Upon retraction of the needle valve 206, fuel is sprayed through the orifices 214 in the nozzle tip 216. A feed-back transducer 226 supplies the electronic control module 174 with the position of the needle valve 206. The electronic control module 174 processes this positional information together with data from the pressure transducer 228 and the end coder 230 for adjusted operation of the electronic valve assemblies 182 and 184 which are monitored by positional transducers 230 and 232.

In phase 3, the end of injection is induced by deenergizing the valve assembly 184 halting the influx of pressurized fuel from the medium pressure pump 186. Simultaneously, with minimal lag, the electronic valve assembly 182 is energized by opening valve A and relieving the pressure from the pressure amplifier 178. Pressure is also relieved from the end of the spool valve 198 such that it is spring displaced to an open position relieving any pressure in the plenum 202 such that the needle valve 206 reseats under pressure from the compression spring 208 and fluid pressure in the backing chamber 210. A piston assembly 196 returns to its pre-charged position in part through pressure of fluid from the auxiliary medium pressure pump 232 entering the opened passage on return of the spool-poppet valve 198. At β1°, the relief valve assembly 182 remains activated to allow recharge of the fuel delivery chamber 200 over a substantial portion of the operating cycle before reclosing at degrees. The use of the check valve 212, that allows unrestricted flow in one direction and restricted flow in the opposite direction, by appropriate construction, provides a desirable needle valve profile with a gradual opening and a sharp, precise closing.

Figure 4B:
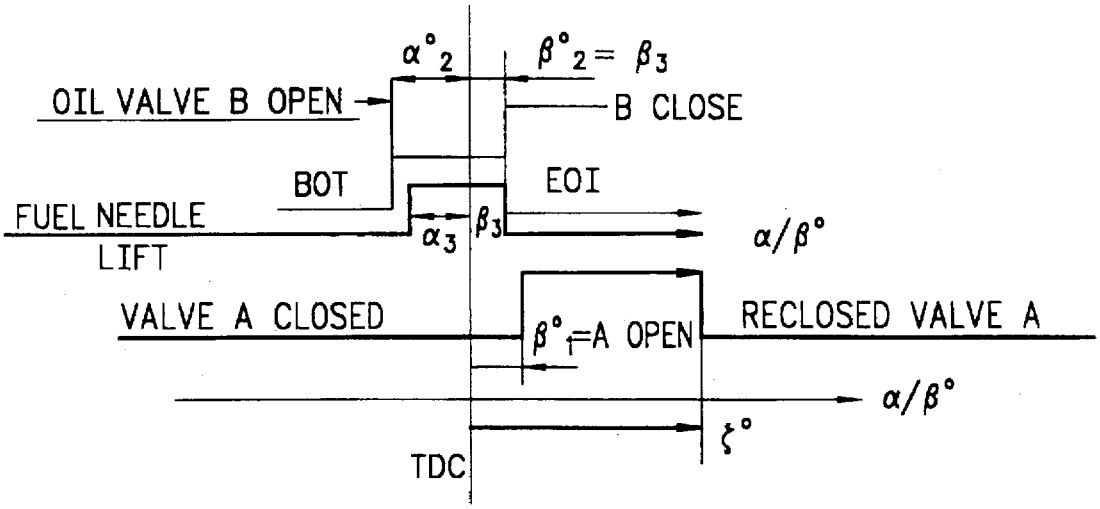
FIG. 4B is a schematic diagram of the phase operation of the fuel injector of FIG. 4A.
Figure 4A:
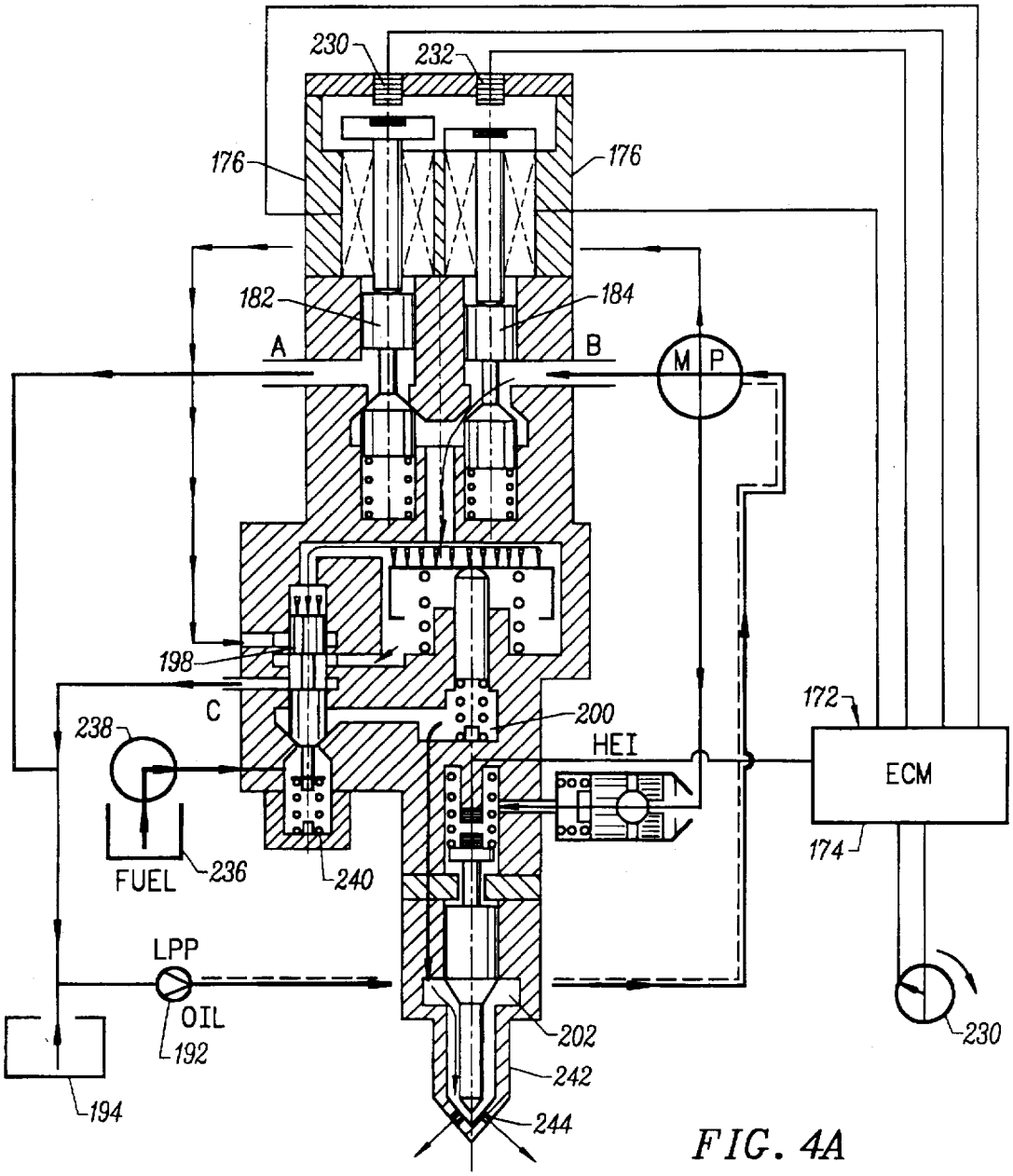
FIG. 4A is a cross-sectional view, partially in schematic, of a forth embodiment of a fuel injector system.

Referring now to FIG. 4A, a further embodiment is shown that is substantially identical to the embodiment of 3A with the exception of an isolated fuel delivery system. The reference numerals for the identical components and elements in 4A are the same as those for 3A with changes in the numerals to reflect the duel-fluid system described with reference to FIG. 4A. In FIG. 4A, a reservoir 194 holds a supply of hydraulic fuel such as a low viscosity oil which is circulated by a low pressure pump 192 to the medium pressure pump 186 for operation of the electronic valve assemblies 182 and 184 as previously described. The hydraulic fluid circulates as previously described except to the fuel delivery chamber 200. Fuel from a reservoir 236 is pumped by a low pressure fuel pump 238 to the fuel delivery chamber 200 when the spool-poppet valve 198 is no longer under pressure from the medium pressure hydraulic fluid delivered to the end of the valve. In such situation, a compression spring 240 displaces the valve and allows fuel to flow from the fuel pump 238 to the chamber 200. As previously noted, the fuel can first be delivered from the fuel pump to a common rail for supply to multiple injectors. Once the fuel delivery chamber 200 is recharged with the piston assembly 196 retracted, the injector is prepared to force delivery of the fuel to the plenum 202 as previously described.

This system allows a non-conventional fuel such as alcohol or other fluid that is not of a high lubrication quality to be delivered by the injector system with minor modification. Depending on the fuel content, viscosity and other characteristics of the fuel, a substitute injector nozzle tip 242 with reconfigured nozzle discharge orifices 244 can be installed. Other adjustments can be made in the manner of operating the fuel injector to accommodate for the particular type of fuel employed. In this embodiment, circulating hydraulic fluid can be selected for its hydraulic properties and the system can be adapted and adjusted for fuel that is available. In effect, the same delivery system with a modified discharge system can be adapted for a wide variety of available fuels.

Figure 3B:
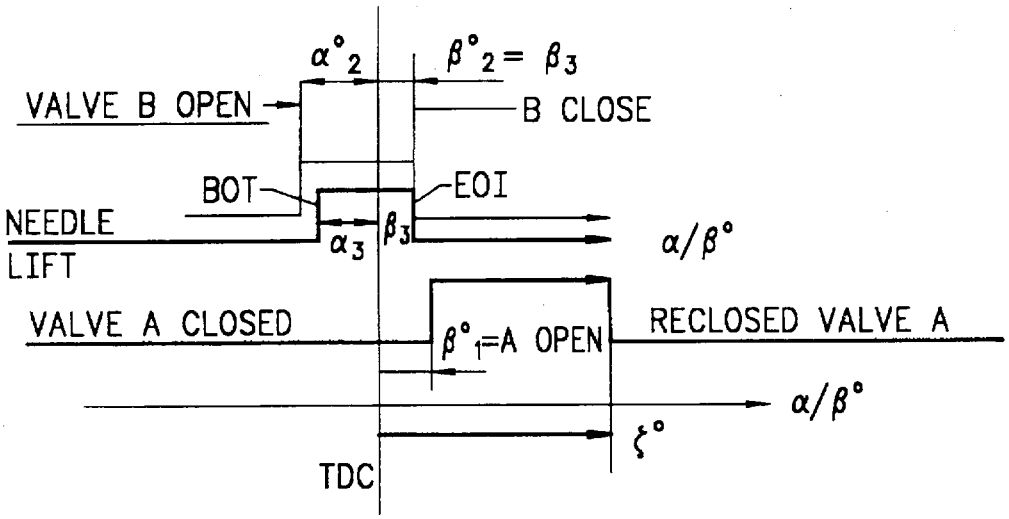
FIG. 3B is a schematic diagram of the phase operation of the fuel injector system of FIG. 3A.

With reference to the schematic diagram of FIG. 4B, the operation is substantially identical to that disclosed with reference to FIG. 3B with the added identification of the fluid to which the noted activity is directed.

Figure 5A:
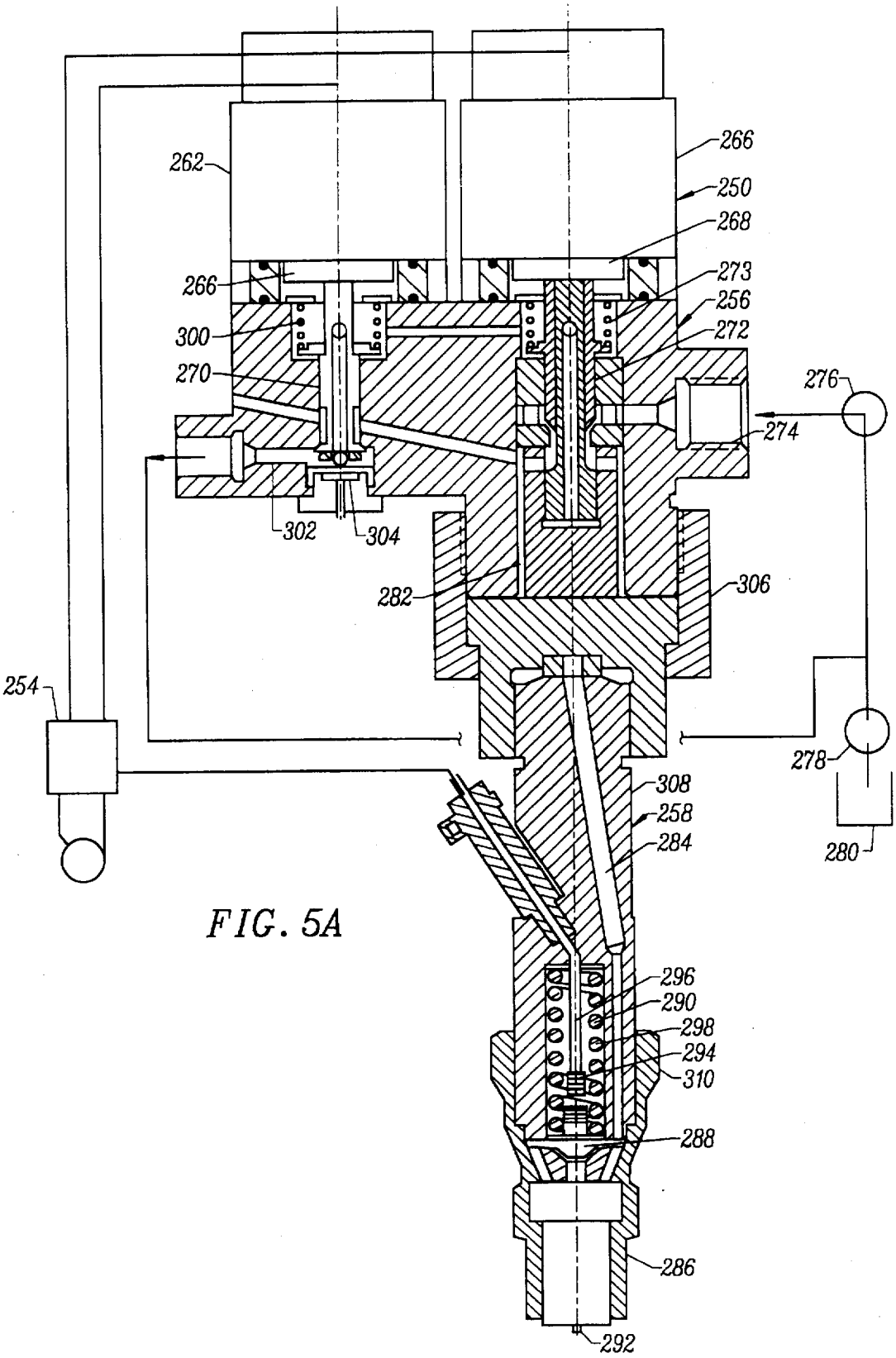
FIG. 5A is a cross-sectional view, partially in schematic, of a fifth embodiment of a fuel injector system.

Referring now to FIG. 5A, a medium pressure fuel injector unit 250 is shown in conjunction with an electronic control network 252 having an electronic control module 254 that coordinates the operation of the fuel injector unit. The fuel injector 250 has a distributor component 256 and an injector component 258. The distributor component 256 has solenoid assemblies 262 and 264 with armatures 266 and 268 that connect to spool-poppet valves 270 and 272.

The slide valve 272 has a compression spring 273 and is connected to the armature 268 such that on activation of the solenoid assembly 266, the armature 268 is retracted displacing the slide valve 272 and allowing passage of fuel through the intake 274 from the medium pressure pump 276 which draws fuel from the low pressure pump 278, which in turn draws fuel from the reservoir 280. Fuel under pressure passes through internal passages 282 in the distributor component and passages 284 in the injector component to the plenum (not shown) of the injector nozzle 286. The needle valve 288 (shown in part) lifts against a compression spring 290 and releases fuel through a nozzle orifice 292. The position of the needle valve 288 is detected by a transducer element 294 on the end of a probe 296 that coacts with a displaceable transducer element 298 on the spring seating end of the needle valve 288. In this manner, the position of the needle valve 288 is sensed and monitored by the electronic control module 254.

In order to closely monitor and control the cut-off of fuel injection, the spool-poppet valve 270 is displaced by deenergizing the solenoid assembly 262 allowing the compression spring 300 to displace the valve 270 and open the passage between the nozzle supply passage 282 and the relief passage 302. The position of the spool-poppet valve 270 is detected by the two-component transducer 304 which is electronically connected to the electronic control module 254.

The fuel injector unit 250 is assembled in a conventional manner with the distributor component 256 connected to the injector component 258 by a collar assembly 306. In a similar manner, the injector nozzle 286 is connected to an injector body 308 by a collar assembly 310. It is to be understood that the assembly of components is accomplished in a conventional manner with due respect to the high pressures and other operating conditions of the components. The arrangement and operation of the described systems, however, differ from those of the prior art.

Figure 5B:
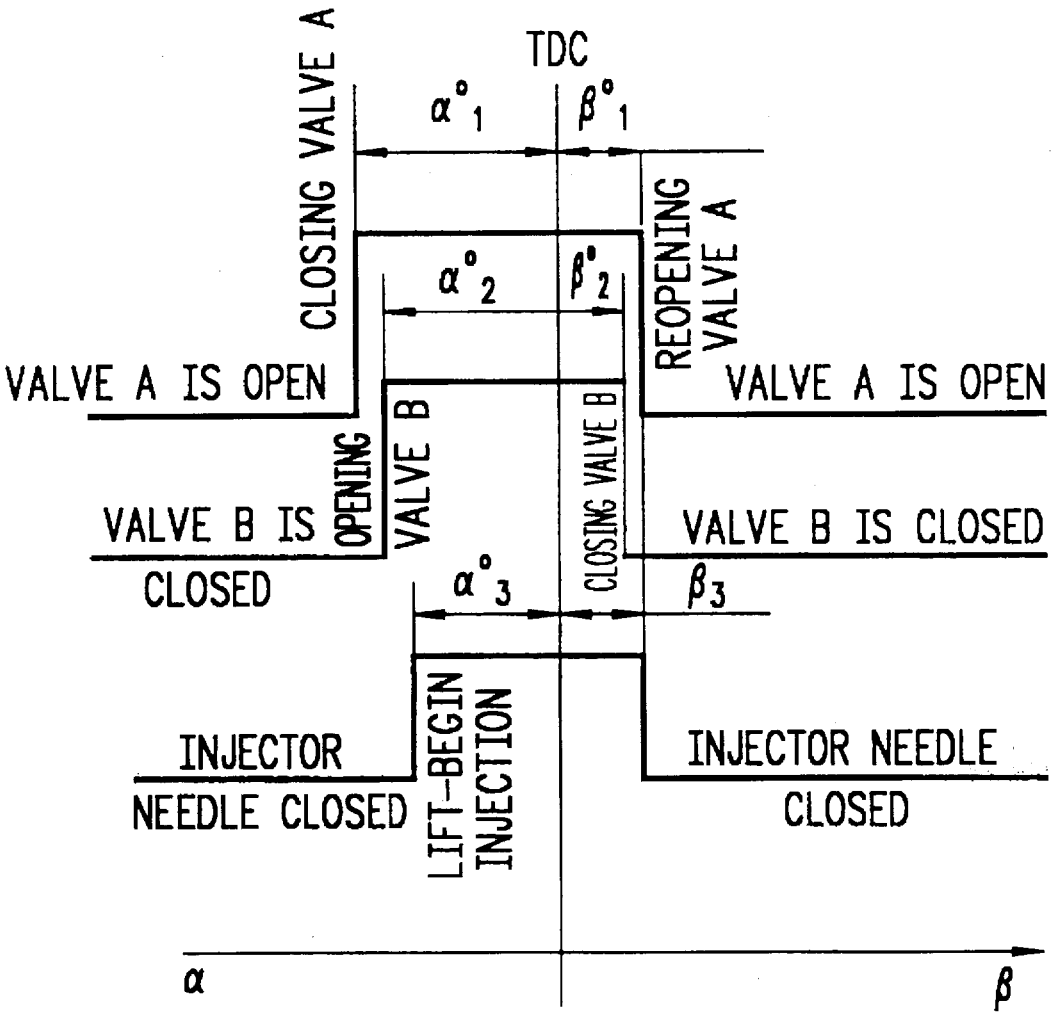
FIG. 5B is a schematic diagram of the phase operation of the fuel injector of FIG. 5A.

In operation, the fuel injector unit 250 of FIG. 5A follows the phase sequence diagrammatically illustrated in FIG. 5B. Referring to FIG. 5B, valve 270 (valve A) is open, up until the angular phase $\alpha 1°$ before top dead center at which point in the operating cycle the valve closes. At $\alpha 2°$ valve 272 (valve B) opens allowing the medium pressure fuel to enter the fuel injector unit and be directed to the needle valve 288. Because of the closed exits in the distributor component, the fuel pressure forces the needle valve to retract and allows an injection to commence. Opening of the needle valve occurs at $\alpha 3°$ which immediately follows the opening of valve B. At $\beta 2°$ after top dead center, valve B closes cutting off the fuel supply to the needle valve and beginning the end of the injection process. The injection is terminated by the reopening of valve A which relieves the internal pressure of the fuel in the injector unit allowing the needle valve spring 290 to close the needle valve.

The electronic control module monitors the needle valve position and the pressure relief valve position and makes adjustments to the actuation of the solenoid assemblies 262 and 266 in accordance with the fuel pulse profile desired to be developed.

Figure 6:
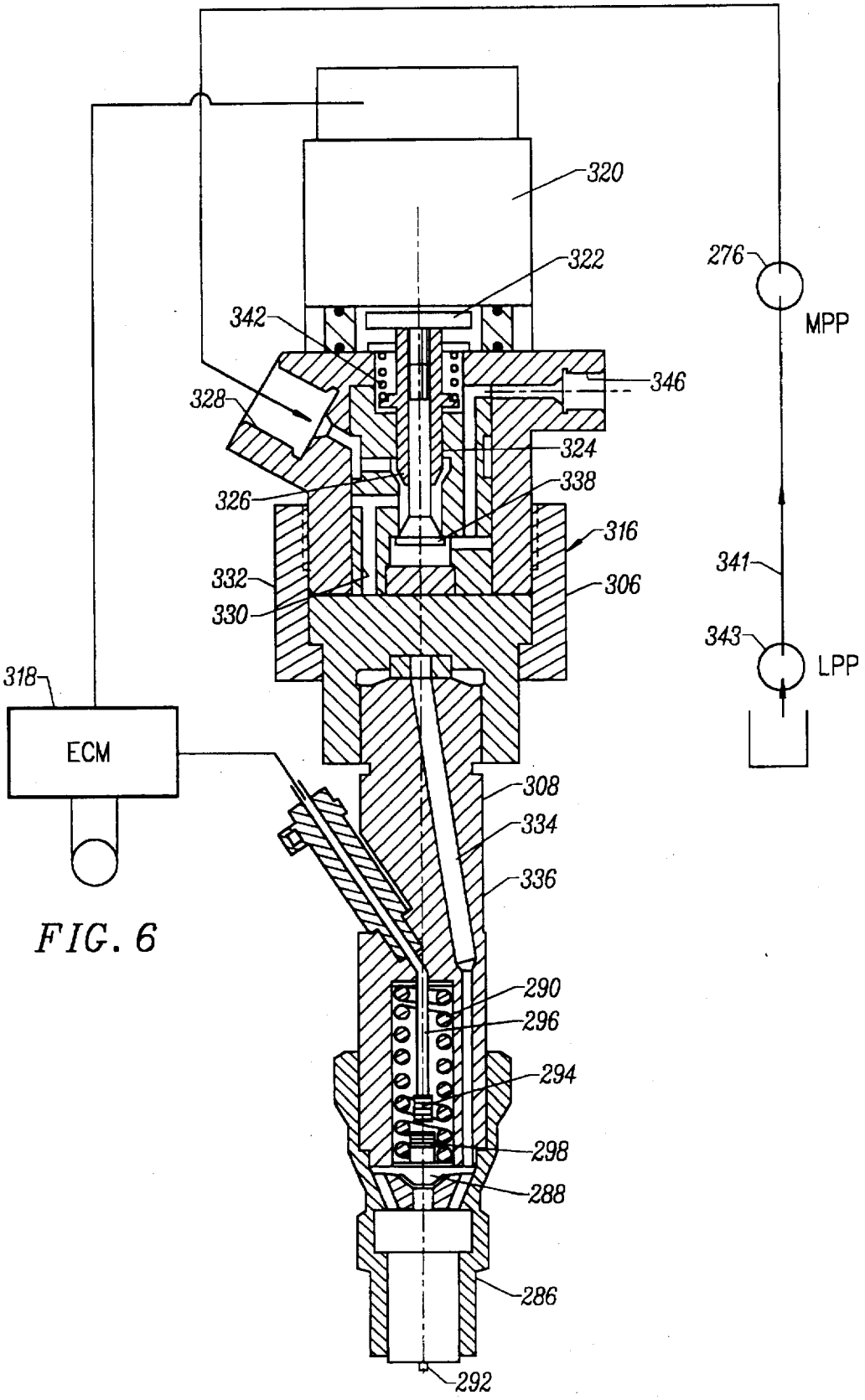
FIG. 6 is a first alternate embodiment of the fuel injector system of the type shown in FIG. 5A.

Referring now to FIG. 6, a fuel injector unit 316 is shown in conjunction with an electronic control network 318. A fuel injector unit 316 and electronic control network 318 are similar in construction to that shown with reference to FIG. 5A. The reference numeral are therefore identical except where the component or element differs in construction or operation.

The fuel injector unit 316 has a single solenoid assembly 320 that has an armature 322 coupled to a double poppet valve 324 having a first valve segment 326 that regulates the communication of the fuel supply inlet 328 with the internal fuel supply passages 330 of the distributor component 332, which communicate with the internal supply passages 334 in the injector component 336. The second valve segment 338 regulates communication of the internal passages 330 with the relief passage 340 that communicates with the low pressure line 341 of the low pressure pump 343. The position transducer elements 294 and 298 or the needle valve 288 provide a position signal for the needle valve 288 that is processed by the electronic control module 254 to provide the feed-back data for operating the solenoid assembly 320.

In operation, the solenoid assembly 320 is energized attracting the armature 322 against the force of a compression spring 342 thereby causing valve segment 326 (valve B) to open and valve segment 338 (valve A) to close. In this position, the medium pressure fuel supplied by the medium pressure pump 276 enters through inlet passage 328 and through internal passages 330 and 334 to the injector nozzle 286. Pressure of the fuel lifts the injector nozzle and allows a pulse of fuel to be injected. Again, the profile and duration of the injected pulse is determined by a sharp cut-off provided by the opening of the second valve segment 338 (valve A) allowing the internal pressurized fuel to be relieved through relief passage 340. As the two valve segments act simultaneously with the displacement of the double acting valve 324 cut-off of the fuel supply is simultaneous with the relief of the internal pressure. Expanding or displaced fuel through the relief passage 340 passes to the low pressure line from the low pressure pump 278.

Figure 7:
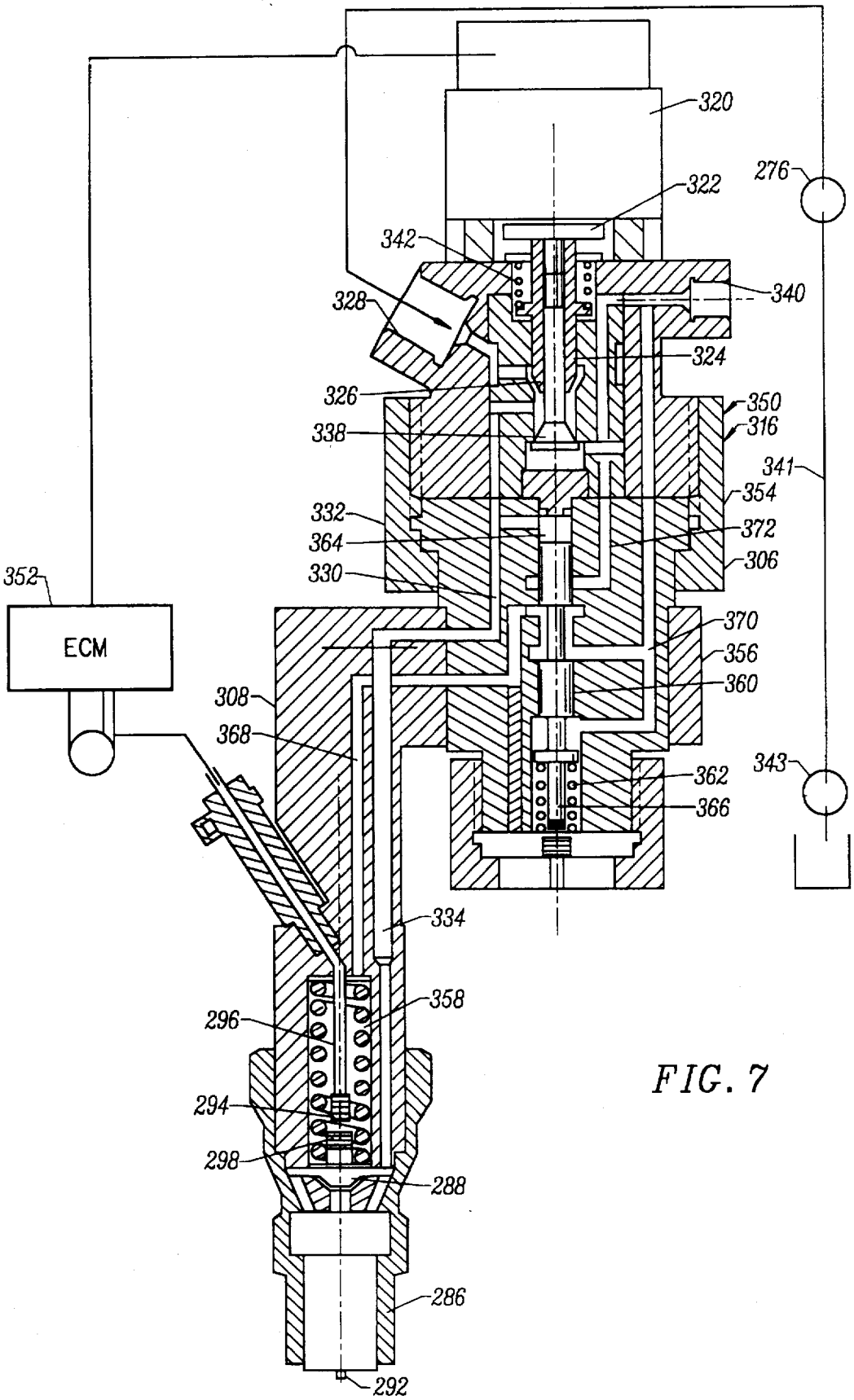
FIG. 7 is a second alternate embodiment of the injector system of 5A.

Referring now to FIG. 7, a fuel injector unit 350 is shown in conjunction with a electronic control network 352 of similar design to that shown with reference to FIG. 6. The fuel injector unit 350 of FIG. 7, however, includes a distributor component 354 having a pressure relief assembly 356 for a needle valve backing chamber 358.

The pressure relief assembly 356 includes a spool valve 360 actuated in one direction by a compression spring 362 and in the opposite direction by hydraulic pressure on the end of the valve 360 at chamber 364. Displacement of the spool valve 360 causes selective opening the closing of passages for charging and relief of the backing chamber 358 of the needle valve 288.

In operation, when double acting valve 324 is actuated by activation of the solenoid assembly 320 causing the armature 322 to act against the compression spring 342 such that the intake passage 340 from the medium pressure pump 276 communicates with the internal passages 330 and 334 to supply the injection fuel to the needle valve 288. Pressurized fuel simultaneously enters the end chamber 364 of the spool valve 360. This pressurization causes displacement of the spool valve 360 against the compression spring 362 until the end stop 366 limits the displacement to the position shown in FIG. 7. In this position, a backing chamber 358 for the needle valve 288 communicates via a passage 368 to the low pressure relief passage 370 which in turn connects to the relief passage 340 to the low pressure line from the low pressure pump.

Alternately, when the solenoid assembly 320 is deactivated, the double acting valve 324 is displaced such that the first valve segment 326 blocks the fuel supply through the fuel inlet 328 and allows pressure within the supply lines to be relieved upon opening of the second valve segment 338 allowing the passages to communicate with the relief passage network 370 to the relief passage 340. Displacement of the spool valve 360 allows a passage 372 from the fuel supply inlet 328 to communicate with the backing chamber passage 368 for pressurizing the backing chamber 358 to cause a pressurized seating of the needle valve 288 by action of the medium pressure fuel supply and the compression spring 358.

Figure 8:
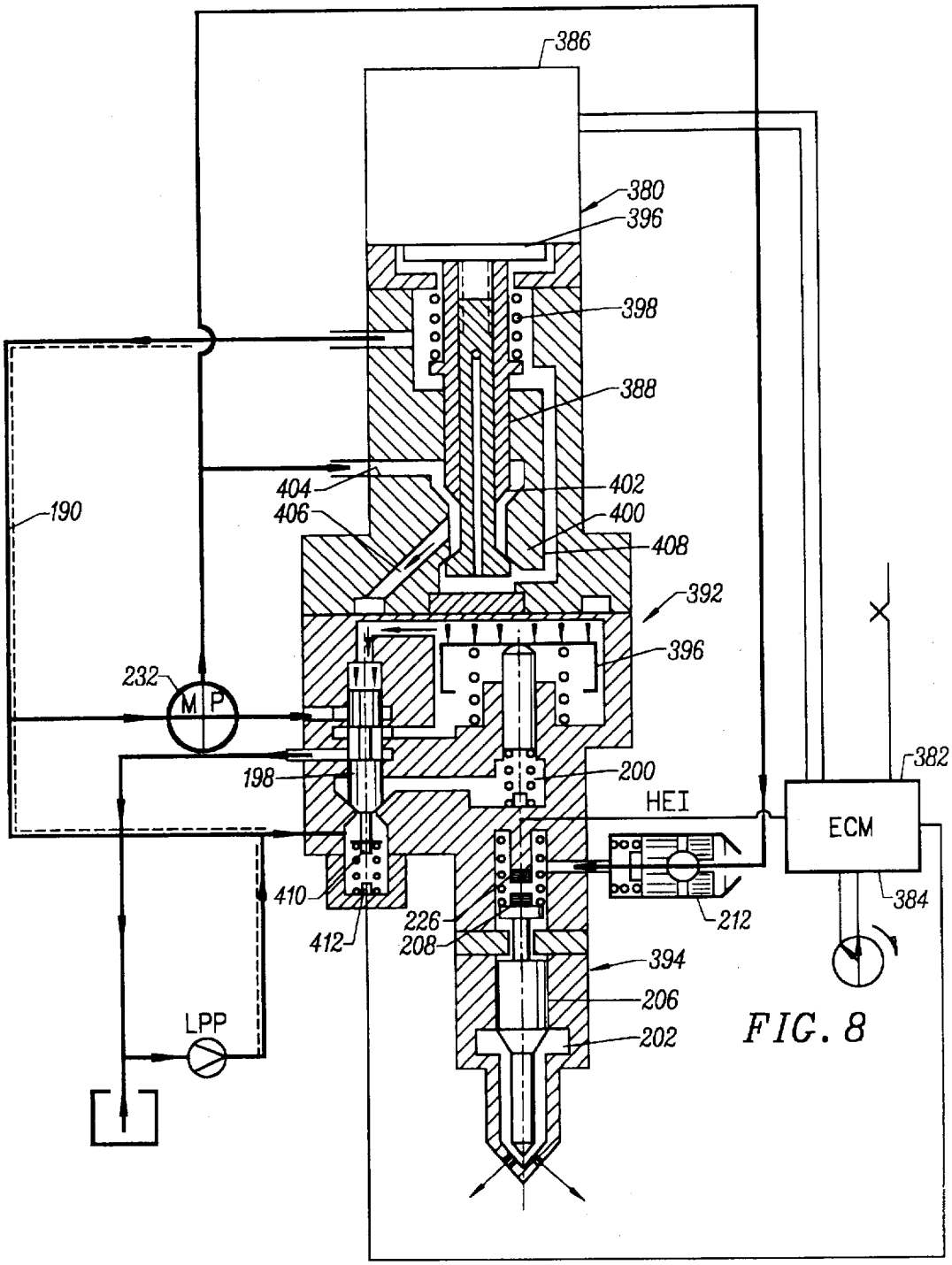
FIG. 8 is a cross-sectional view, partially in schematic, of a sixth embodiment of a fuel injector system.

In the embodiment of FIG. 8, a fuel injector unit 380 is combined with an electronic control network 382 having an electronic control module 384 for electronically coordinating the operation of the injector unit 380. The embodiment of FIG. 8 includes a single solenoid assembly 386 for actuation of a double acting valve assembly 388 in a distributor component 390 of a similar construction to that shown in FIGS. 5A, 6 and 7. The distributor component 390 is coupled to a pressure amplifier component 392 that in turn is coupled to a injector component 394.

The pressure amplifier component 392 and the injector component 394 operate in the same manner as the distributor 176, pressure amplifier 178 and injector 180 of the fuel injector unit 170 in FIG. 3A.

The single solenoid assembly 386 substitutes for duel solenoid assembly 185 of FIG. 3A. When energized, the solenoid assembly 386 attracts the armature 396 and the connected double acting valve assembly 388 against the force of a compression spring 398. The first valve segment 400 of the double acting valve assembly 388 is moved to a closed position, and the second valve segment 402 is moved to an open position allowing fluid from the medium pressure pump 232 to pass the inlet passage 404 for routing internal passageways 406 to the pressure amplifier component 392. Pressurized fluid is also routed to displace the spool poppet valve 198 for sealing the fuel delivery chamber 200 to allow the pressure piston assembly 396 of the pressure amplifier component 392 to force fuel from the delivery chamber 200 into the plenum 202. The high pressure fluid in the plenum causes the needle valve 206 to retract and the injection to proceed. The transducer elements 226 and 208 sense the position of the needle valve 206 and feed the data to the electronic control module 384 for processing and regulation of the solenoid assembly 386.

When the solenoid assembly 386 is deactivated, the compression spring 398 returns the double acting valve assembly 388 to its rest state such that the first valve segment 400 opens the relief passage 408 to the low pressure line 190. The second valve segment 402 displaces to a closed position blocking the internal passageways 406 from the medium pressure pump 232.

The embodiment of FIG. 8 is equipped with a pressure relief 212 for control of the needle valve retraction and abrupt termination of the injector pulse, as previously described. Added monitoring of the activity of the solenoid assembly 386 is provided by transducer elements 410 and 412 for the poppet spool valve 198. The signal is fed to the electronic control module 384 and coordinated with the signals for needle valve lift and solenoid response.

Figure 9A:
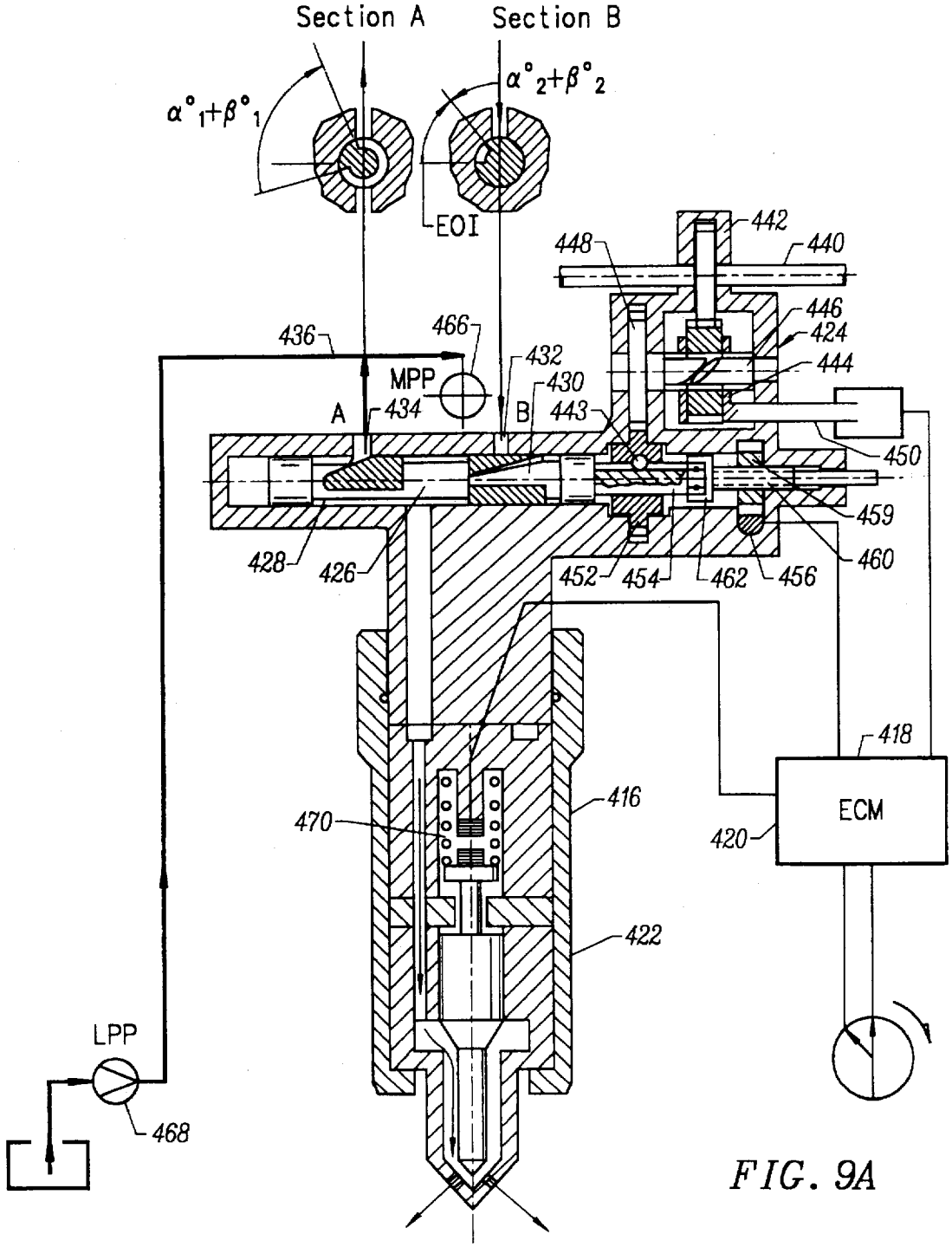
FIG. 9A is a cross-sectional view, partially in schematic of a seventh embodiment of a fuel injector system.

Referring now to the fuel injector system of FIG. 9A, a fuel injector unit 416 is shown in conjunction with an electronic control network 418 with a electronic control module 420 that operates as previously described. The injector unit 416 has an injector 422 connected to a rotary valve distributor component 424 having an electro-mechanical operation for fuel distribution to the injector component 422. The rotary distributor component 420 includes a rotary spool valve 426 that is provided with two spiral-profile, hydraulic cams 428 and 430 controlling the intake passage 432 and relief passage 434 for the fuel supply 436 of the injector unit 416.

Rotation of the engine drive shaft (not shown) is transmitted to the gear shaft 440 upon which is mounted a drive gear 442 that engages a slide gear 444 carried on a spiral-splined shaft 446 to advance or retard the rotation of a fixed shaft gear 448 depending on the displacement of the slide gear 444 on the shaft 446 by an actuator 450 under control of the electronic control module 420. The shaft mounted gear 448 engages a keyed slide gear 452 that is spline mounted to the shaft axis 454 of the rotary spool valve 426. Linear actuation of the shaft 454 is accomplished by a rack member 456 that engages a gear 458 with core that threads engage a threaded section of the shaft 460, such that linear displacements of the rack 457 are translated into linear displacements of the rotary spool valve 426 along its axis. The rotary displacement means is connected to the rotary spool valve 426 by a ball bearing connector 462 such that rotations of the threaded shaft 460 for displacement do not interfere with the intended rotation and phase shifts caused by the electronically controlled actuator mechanism 450. The displacement of the rack member 456 is also controlled by the electronic control module 420 as shown in FIG. 9A. The ball key 453 allows the valve shaft 454 to be displaced linearly while maintaining engagement of the gear 452 for rotary adjustments.

Figure 9B:
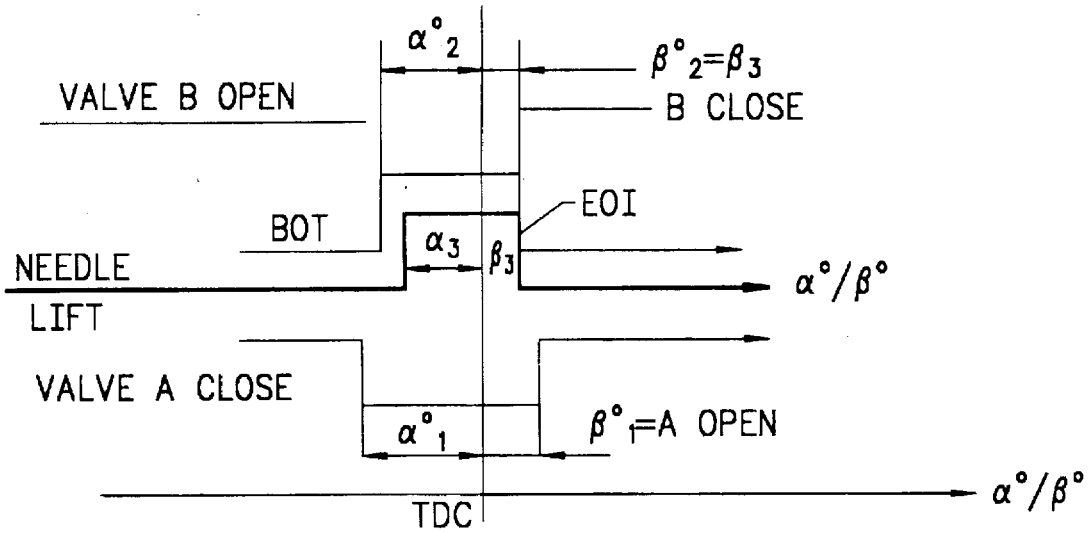
FIG. 9B is a schematic diagram of the operation of the fuel injector system of FIG. 9A.

Referring now to FIG. 9B, the operation of the fuel injector system of FIG. 9A is schematically disclosed. At $\alpha 1°$ before top dead center, the cam-like valve segment 426 blocks the relief passage 434 and momentarily thereafter at $\alpha 2°$ the cam-like valve segment 430 (valve B) opens the intake passage 432 permitting fuel to flow through the distributor component 424 to the injector component 422. As previously described, the medium pressure fuel delivered from the medium pressure fuel pump 466 assists the needle valve to lift as previously described. Injection can be advanced or retarded by displacement of the spline gear 444 which is translated to the drive gear 448 for cycling of the rotary spool valve 426. Similarly, the profile or duration of the injection process can be varied by displacements along the axis of the rotary spool valve 426 by the actuator rack 456. At $\beta 2°$ the cam-like valve segment 430 (valve B) closes the intake passage 434 blocking induction of pressurized fuel from the medium pressure fuel pump 466 to the injector 422. Shortly thereafter at $\beta 1°$, the relief passage is opened by the position of the cam-like valve segment 428 (valve A). The position of valve segment 428 allows the pressurized fuel within the fuel injector unit to be relieved to the low pressure line 436 of the low pressure pump 468. A stationary transducer element 470 cooperates with a moveable transducer element 472 on the needle valve for signaling the position of the needle valve to the electronic control module as previously described. In this manner, the rotation of the injection process and hence the quantity of fuel discharged together with the phase of the delivery in the operating cycle can be controlled under regulation by the electronic control module.

Figure 10B:
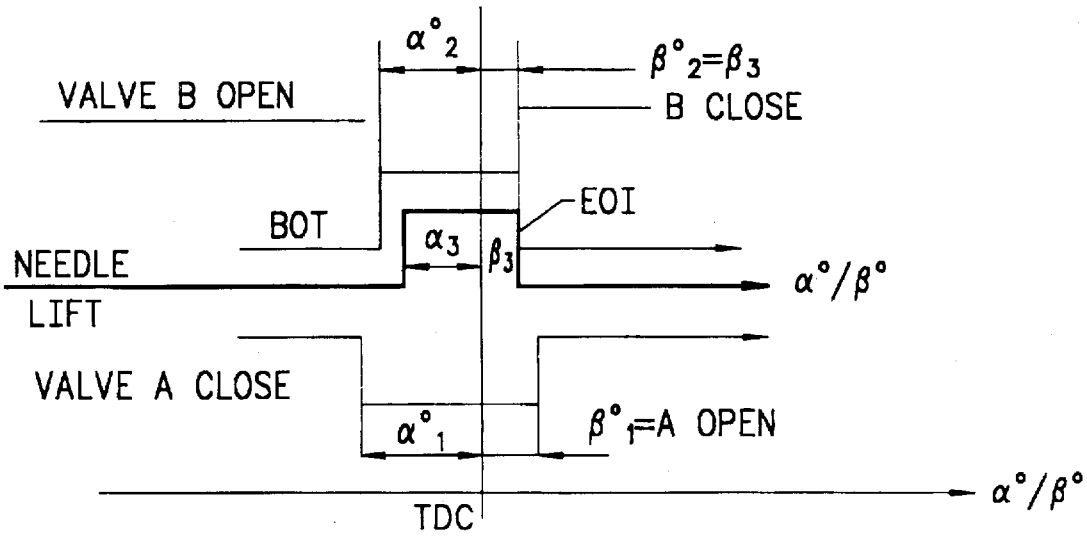
FIG. 10B is a schematic diagram shown the operation of the fuel injector system of FIG. 10A.
Figure 10A:
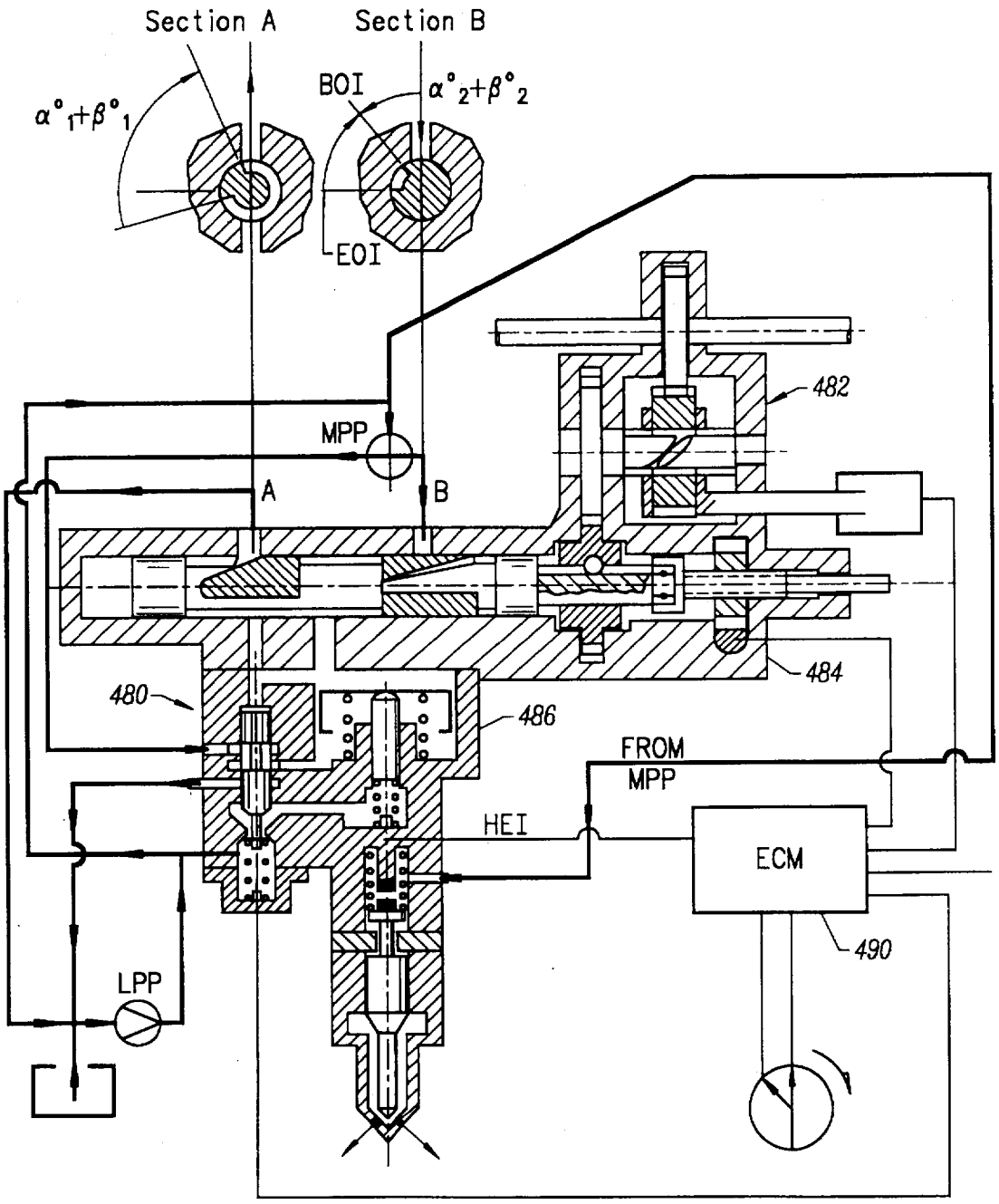
FIG. 10A is a cross-sectional view, partially in schematic, of an eighth embodiment of a fuel injector system.

Referring now to FIG. 10, fuel injection system 480 is shown having a fuel injector unit 482 with a rotary distributor component 484 that is constructed and operated in the same manner as the rotary distributor component 424 of FIG. 9A. The rotary distributor component 484 is coupled to a pressure amplifier 486, which is the same as the type described with reference to FIG. 1A. In this fuel injector system 480, the pressure amplifier component 486 is utilized to boost the injection pressure of the fuel for extremely high pressure engines. Again, the electronic control module 490 monitors the needle valve position and correlates with the injection process with the components that control the phase, duration and profile of the injection pulse as previously described.

Figure 11:
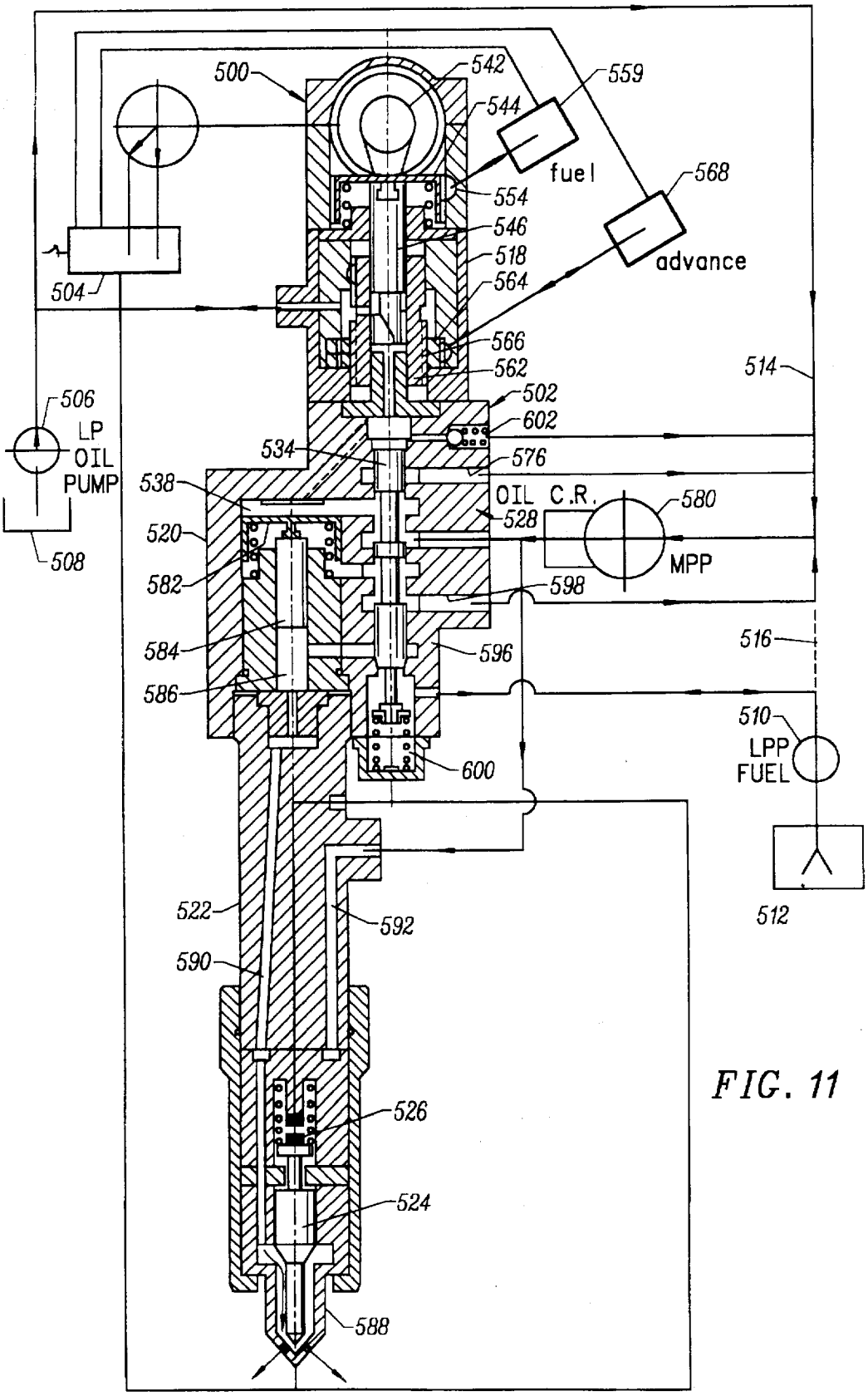
FIG. 11 is a cross-sectional view, partially in schematic, of a ninth embodiment of a fuel injector system.

Referring now to FIG. 11, a fuel injection system 500 is disclosed that utilizes an electro-mechanical actuating system for injecting super high-pressure fuel into an engine component. The fuel injection system 500 includes a fuel injector unit 502 and electronic control network 504 that in part controls the operation of the fuel injector unit 502. The fuel injection unit 502 is designed as either a single fluid system in which the fuel acts both as a hydraulic medium and fuel, or, with minor routing of the fluid supply circuits, the unit functions as a duel system with a circulated hydraulic medium and a separate fuel discharge circuit. This allows use of available fuels that are not suitable for use as a hydraulic medium either because of their compressibility or lack of lubrication characteristics. Where a common fluid can be use, such as diesel fuel, the separate low pressure pump 506 the hydraulic fluid that circulates form the hydraulic fluid reservoir 508 can be eliminated and a single low pressure fuel pump 510 connected to the fuel reservoir 512 can supply the hydraulic circuit 514 by communicating conduit 516, shown in phantom in FIG. 11. The operation of the fuel injector unit 502, however, remains substantially the same.

The fuel injector unit includes an electro-mechanical hydraulic actuator component 518 that is connected with a pressure amplifier component 520 which in turn is connected to an injector component 522. The injector component 522 is similar to the injector components previously described with a needle valve 524 having a transducer 526 for signaling the electronic control module 504 of the real-time position of the needle valve 524. The fuel injector unit 502 includes a hybrid distribution component 528 that is intermediary of the actuator component 518 and the amplifier component 520. Furthermore, the hybrid distributor component can be modified by a bypass passage 530, shown in phantom that allows the actuator component to hydraulically actuate a multiplier piston assembly in the amplifier component as well as to actuate a poppet-spool valve 534 in the distributor component 528. The bypass passage 530 interconnects a distribution chamber 536 with the large-diameter piston chamber 538.

The actuator component 518 has a displacement mechanism 540 which is in this embodiment a rotating cam 542 with a rotation coordinated with the engine drive shaft (not shown). Other displacement mechanisms can be employed such as a plunger or other preferably mechanical means. While electro-mechanical actuators can be employed, it is one object of this embodiment to utilize a mechanically based operating system that will continue to operate during failure of the electronic components, although perhaps not at the optimum efficiency. The rotating cam 542 contacts a head 544 of a plunger 546 that is loaded by compression spring 548. The plunger 546 has a helical valve segment 550 that alters the exposure period to a low pressure passage 522 depending on the axial orientation of the valve segment 550 as controlled by a displaceable rack member 554. The rack member 554 engages the side of the plunger head 544 and rotationally displaces the plunger 546 according to a servo mechanism 558 under electronic control of the electronic control module network 504.

In a similar manner, the displaceable sleeve 562 has a threaded surface engaged by threaded collar 564 that is rotated by a linear displaceable rack 566 under control of an actuator 568. The rotating collar 564 orients the communicating port 570, linearly along the axis of the plunger 546. The actuator 558 controls the pulse duration and the actuator 568 controls the pulse phase during the operating cycle under master control of the electronic control network 504. The sleeve 562 is keyed from rotation by a key-slot mechanism device 572.

Low pressure fluid having hydraulic properties is pumped to the actuator component through the passage 552 when the plunger 546 is retracted. The fluid is forced into the distribution chamber 536 and displaces the poppet-spool valve 534 to block a relief passage 576 and open a fluid passage from the medium pressure pump 580 for supply of fuel to the top side of the pressure multiplying piston 582. Pressurized fluid displaces the large diameter piston 582 and small diameter plunger 584 for displacing under high pressure, a pulse of fuel in the fuel delivery chamber 586. High pressure fuel is delivered to the injector nozzle 588 through a delivery passage 580. For abrupt and firm closure of the needle valve 524 after the injection process has ceased, a needle valve backing chamber passage 592 is connected to the medium pressure pump supply immediately upon cessation of the injection pulse.

Concurrently with the opening of the intake passage to the piston chamber 538, the poppet-spool valve 534 blocks the exit passage 596 from the fuel delivery chamber 586 and opens the relief passage 598 to relieve displaced fuel from behind the large diameter piston 582.

In the alternate embodiment having a bypass channel 530 between the chamber 536 and distributor chamber 536 and piston chamber 538, the plunger fluid that is displaced by the plunger assists in displacing the piston 582.

When the plunger 546 is retracted and the poppet-spool valve 534 is returned under force of a compression spring 600. Fuel from a low pressure fuel pump is allowed to recharge the chamber 586 upon opening of passage 596. Similarly, fluid from the medium pressure pump is allowed to enter behind the large diameter piston 582 with relief of any pressure in the piston chamber 538 passing through passage 576. A pressure control valve 602 provides a pressure limit for the hydraulic system using a spring loaded check valve.

The position of the needle valve 524 is detected by the transducer 526 and signal supply to the control module network 504 for coordination with other input parameters and control of the actuators 558 and 568 for altering the characteristics of the fuel injection pulse. As noted, where the fuel has appropriate hydraulic fluid characteristics, the low pressure hydraulic fluid pump 506 can be eliminated and a connecting conduit 516 can be hydraulically coupled the fuel circuit and hydraulic control circuit for single fluid systems.

Referring now to FIGS. 12A–12D, an integrated actuator and pressure multiplier component 608 is shown for use with the injectors of the type previously described. The pressure multiplier component 608 operates with a fuel injector 610 and an electronic control network shown schematically as 612. The integrated actuator and pressure multiplier component 608 has a solenoid actuator assembly 614 with an armature 616 that is connected to a unique double acting poppet-spool valve 618. The poppet-spool valve 618 has a first valve segment (valve A) 620 on sleeve 622 and a second valve segment (valve B) 624 at the end of a core 626.

Figure 12A:
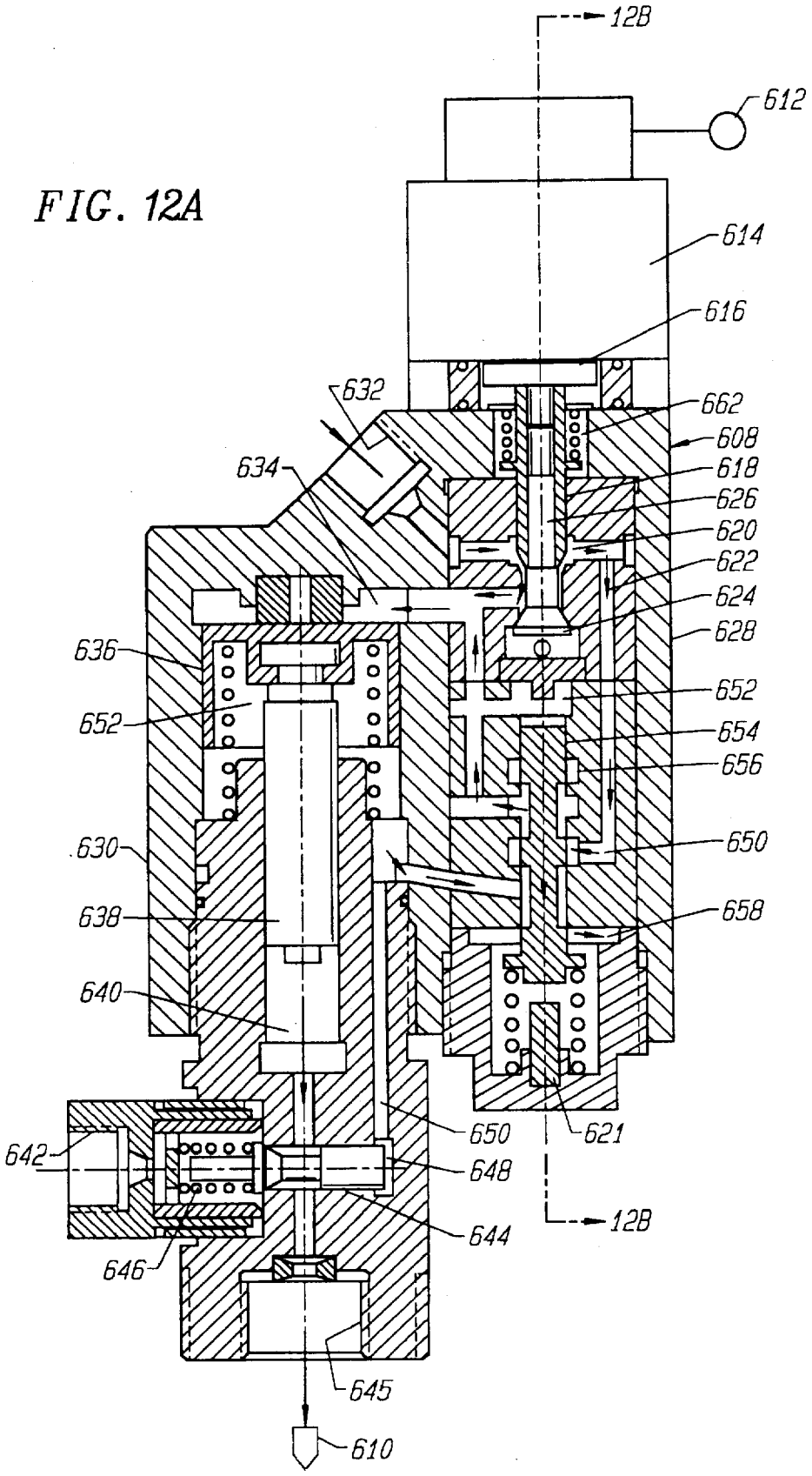
FIG. 12A is a cross-sectional view, partially in schematic, of a tenth embodiment of a fuel injector system.
Figure 12B:
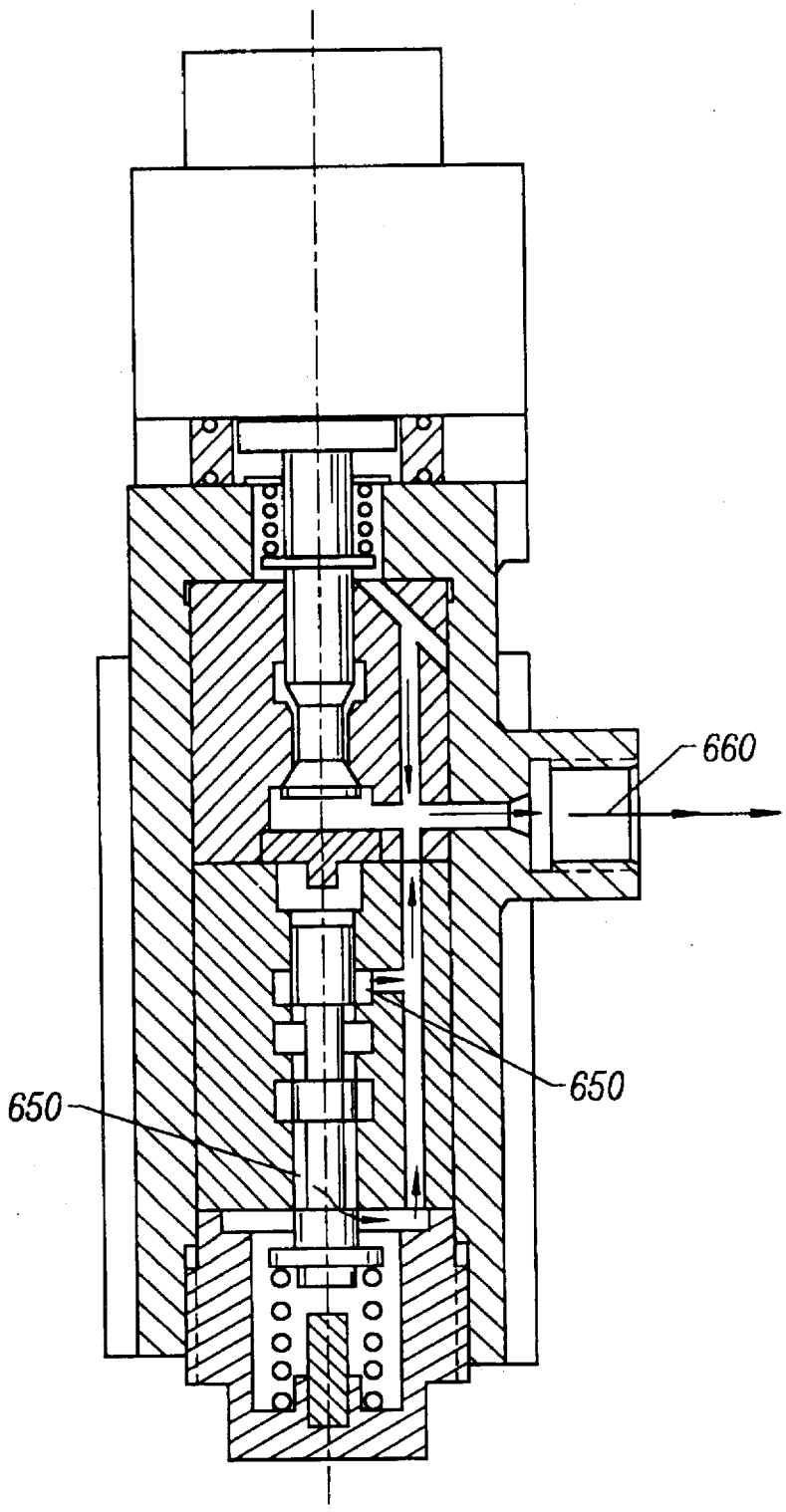
FIG. 12B is a cross-sectional view taken on the lines 12B—12B in FIG. 12A.

In order to depict the internal passages for high and low pressure fluid circuits, the structure of the integrated component 608 is also shown in cross section in FIG. 12A. FIGS. 12A and 12B depict the integrated component during injection time, and for clarity, FIGS. 12C and 12D depict the component in the injector closed time.

The integrated actuator and pressure multiplier 608 combines the solenoid actuator assembly 614 with a distributor assembly 628 and a pressure multiplier assembly 630. The distributor assembly 628 includes a medium pressure induction passage 632. On activation of the solenoid actuator assembly and retraction of the armature 616, the valve segment 620 opens allowing communication of the induction passage 632 with the piston chamber 634 of a piston multiplier assembly 636. Displacement of the piston plunger 638 displaces fuel in the fuel delivery chamber 640, which has been charged by a low pressure fuel through inlet 642. The fuel bypasses poppet slide valve 644, acting as a valve allowing the fuel into the fuel delivery chamber 640 but not out, delivered through the delivery passage 646 to the injector 610. The poppet slide valve 644 is displaced by a compression spring 646 against fluid in the hydraulic chamber 648 at the end of the valve 644 as described. With the first valve segment 620 open, the medium pressure fluid is routed to the piston multiplier chamber 634 and by a passage network 650 routed to a chamber 652 where the fluid hydraulically displaces a regulator spool valve 654, which blocks a passage 656 to the induction fluid but opens a passage 658 for relief of fluid in the piston backing chamber 652 allowing escape of fluid as the piston 636 descends in its injection down stroke. Fluid in the backing chamber proceeds through bypass passage 666 to the relief passage 660 that communicates with the low pressure fluid supply (not shown). Internal passage 650 to the backing chamber 648 of the checking valve 644 also communicates with the relief passage 660 enabling the previously described displacement of the poppet slide valve 644 by compression spring 646.

Figure 12C:
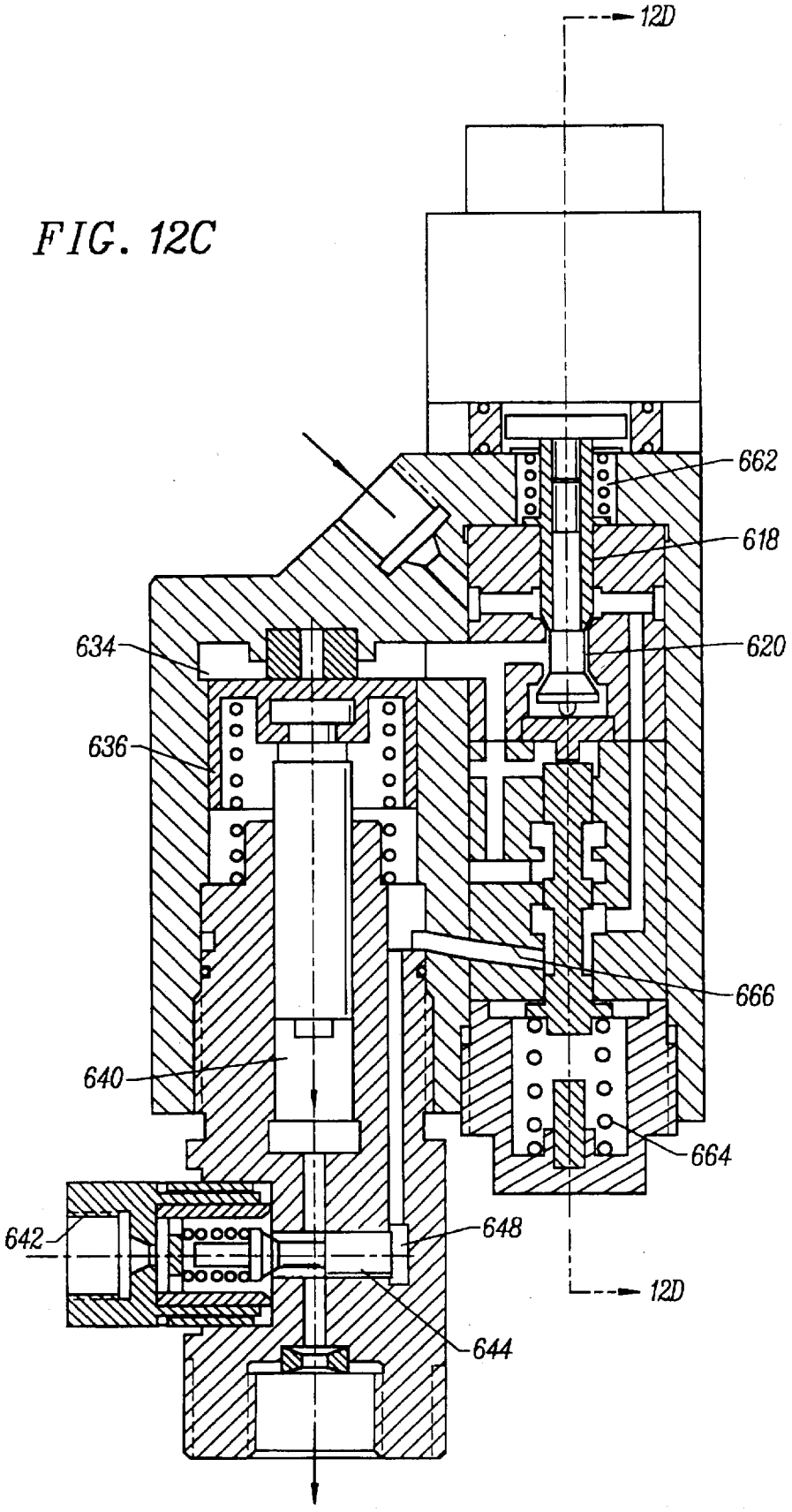
FIG. 12C is a cross-sectional view, partially in schematic of the fuel injector system of FIG. 12A in a different phase of operation.
Figure 12D:
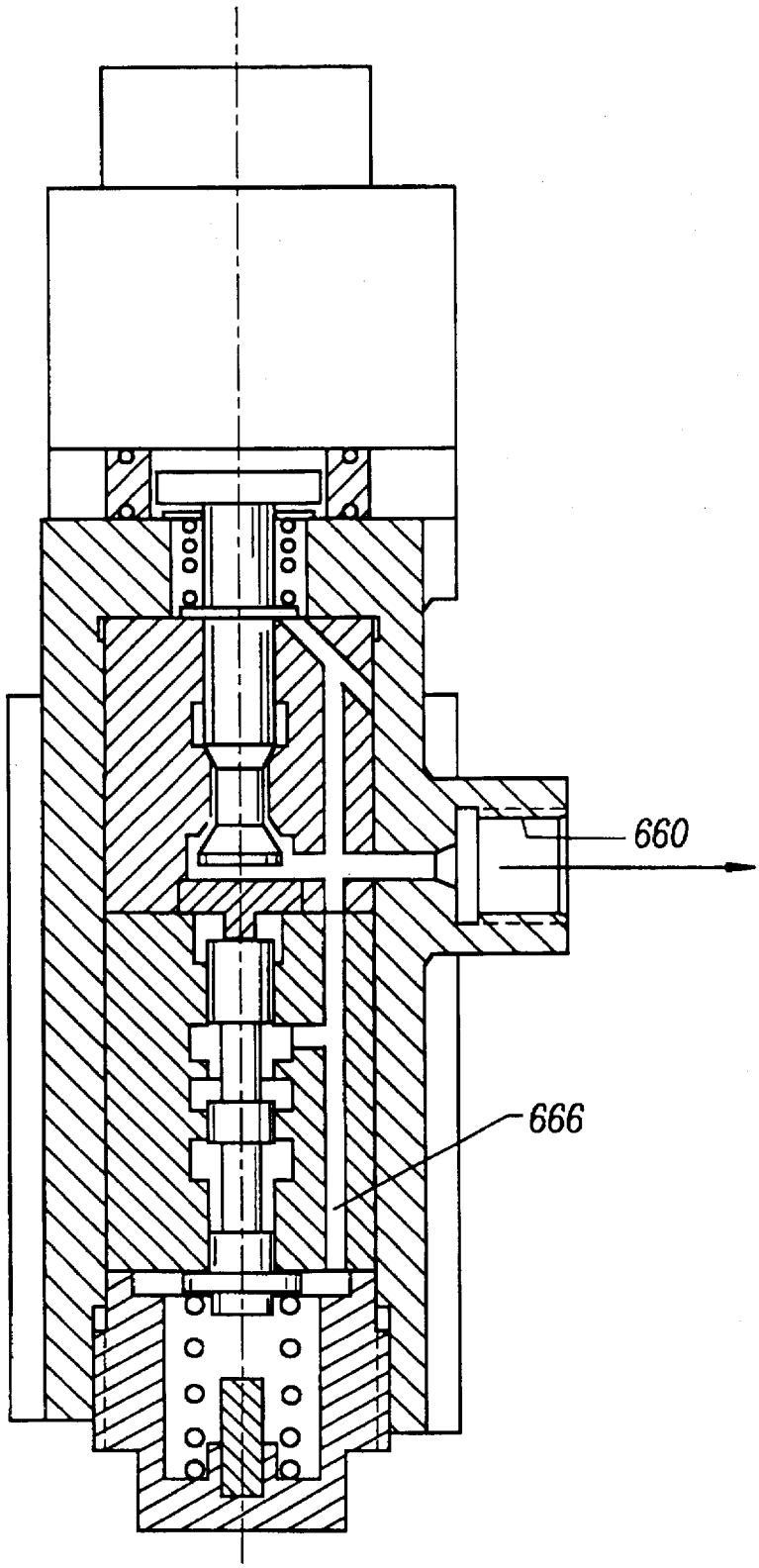
FIG. 12D is a cross-sectional view of the fuel injector system of FIG. 12C taken on the lines 12D—12D in FIG. 12C.

When the solenoid actuator assembly 614 is deenergizing, the compression spring 662 displaces the poppet spool valve 618 such that the first valve segment 620 (valve A) blocks the passage to the medium pressure fluid supply inlet 632, as shown in FIG. 12C. Simultaneously, the second valve segment 624 (valve B) opens allowing communication of the multiplier piston chamber 634 with the relief passage 660. This allows any fluid in the chamber 634 to escape as the piston assembly 636 returns to its preinjection position. The spool valve 624, no longer under influence of the medium pressure fluid, is displaced by a compression spring 664 to permit routing of the medium pressure fluid through the bypass passage 666 to the backing chamber 652 of the piston multiplier assembly 636. The pressurized fluid causes immediate return of the piston assembly 636 to its preinjection position. Similarly, the medium pressure fluid communicates with the end chamber 648 of the checking valve 644 opening the fuel delivery chamber 640 and the injector supply passage 645 to the low pressure fuel delivery passage 642 for fuel recharge.

The duel pressure circuits of the integrated actuator and pressure multiplier component 608 of FIGS. 12A–D allow for rapid response utilizing a short servo actuator stroke for instantaneous induction and cut-off in response to control signals. Furthermore, the rerouting of the differentially higher pressure supply for both the power stroke of the piston multiplier assembly and the return stroke of the assembly provides for rapid recovery necessary in high speed operation. Finally, the ability to isolate of the fuel delivery circuit from the hydraulic actuating circuit enables the use of different fluids for the hydraulic circuit and the fuel delivery circuit. The integrated component of FIGS. 12A–12D is useable with a variety of fuel injectors such as those shown in the previous Figs.

Referring now to FIGS. 13A–14B, a modular injector control unit 680 is shown for coupling to a standard injector, such as the injector component 522 of the injector system 500 of FIG. 11. The modular injector control unit 680 is operated under monitoring and control of an electronic control module 682 shown schematically in FIG. 13A. The electronic control module 682 is connected to the standard electronic sensors for monitoring operation of an engine as previously described. Additionally, to achieve operational control over the modular injector control unit 680 for precision metering of a staged injection pulse, additional sensors are added to provide cycle-by-cycle feed-back allowing the electronic control module 682 to regulate operation of the modular injector control unit 680.

The modular injector control unit 680 has a housing assembly 684, with a threaded output connector 686 for coupling to a conventional injector or preferably an injector component 522 of the type shown in FIG. 11, which includes an added sensor for determining the injector needle valve position during the operating cycle.

By individually coupling control unit modules with discrete injectors, each injector can be discretely monitored and regulated according to a predefined map of performance characteristics for the coupled control unit and injector. Deviation from the mapped characteristics over time can be corrected in the reference operating program in order that a multi-cylinder engine will operate at peak performance with the profile of each injector assembly individually correctable over time.

The modular injector control unit 680 has a fuel intake connector 688 proximate the output connector 686 with a passage 690 protected by a ball and spring check valve 692. A common internal passage 694 communicates with a variable volume piston chamber 696, in which a high pressure injection piston 698 reciprocates against a bias spring 700. The high pressure injection piston 698 is coupled to a larger diameter amplifier piston 702 that is a hydraulically driven piston reciprocating in amplifier chamber 704 against bias spring 706. The cylindrical chamber 704 at the backside of the amplifier piston 702 includes a vent manifold 708 for relieving back pressure or suction on displacement of the amplifier piston 702.

The amplifier piston 702 has a front face 710 that defines the surface area in communication with the hydraulic driving fluid in the amplifier chamber that hydraulically displaces the amplifier piston 702, and hence the connected high pressure injection piston for injecting a pulse of fuel through output passage 711 into any coupled fuel injector.

The modular injector control unit 680 has a connected control head 712 that selectively shunts a medium pressure hydraulic fluid such as a supply fuel or dedicated hydraulic fluid from a pressurized source 714 at a pressure of 5,000–10,000 p.s.i. to a hydraulic fluid intake connector 716 in the control head 712, that selectively leads to the amplifier chamber 704.

A valve system having three spool valves 718, 720 and 722 control the fluid flow from the intake connector 716, to the amplifier chamber 704 to contact the front face 710 of the amplifier piston 702, and finally to a discharge connector 724. Spool valves 718 and 720 shown in greater detail in FIGS. 14A and 14B are connected to armatures 726 and 728 of electronic solenoid actuators 730 and 732. The solenoid actuators 730 and 732 are electronically controlled and activated by the electronic control module 682 for precision opening and closing of the pathways for the drive fluid.

Spool valves 718 and 720 are hybrid spool-poppet valves, spool valve 718 comprising an induction valve and spool valve 720 comprising a discharge valve. Spool valve 722 is a spring-biased commuter valve. The armature 726 of solenoid actuator 730 is connected to one end of induction valve spool 732, which is constructed with a constricted section 734. On activation of armature 726, for injection displacement of induction valve spool 732, allows fluid to pass from intake connector 716 through internal passage 736 to the end of commuter valve spool 738 and to the concentric perimeter 740 of amplifier piston 702 for initial displacement of the amplifier piston 702. With discharge valve 720 closed, resulting from activation of solenoid actuator 732 to pull discharge valve spool 742 against compression spring 744 to close the passage 746 to a discharge connector 748, the pressure against commuter valve spool 738 rises and displaces the spool 738 against return spring 750. The displacement allows fluid to pass to the central bypass passage 752 for full flow to the amplifier piston 702 for primary displacement of the amplifier piston 702 to produce the primary fuel pulse for the connected injector.

On deactivation of solenoid actuator 730, armature 726 is displaced by compression spring 752 to close passage 736 from the pressurized source 714 at the intake connector 716.

On deactivation of solenoid actuator 732, armature 728 is displaced by compression spring 744 to open the internal passage 736 to the discharge passage 746 to discharge connector 748.

Figure 13A:
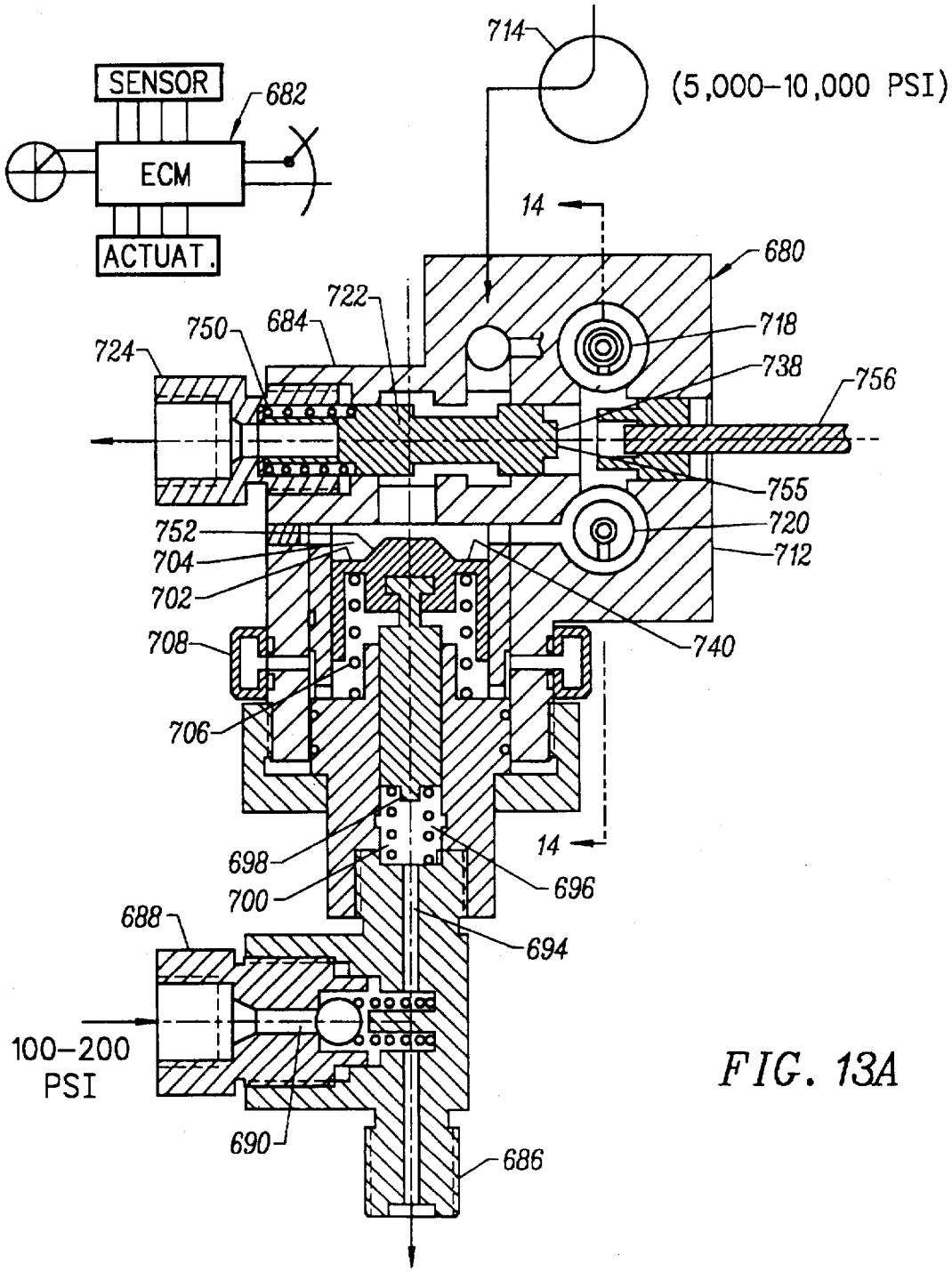
FIG. 13A is a side elevational, cross sectional view of the modular injector unit with a commuter valve in an open position during injection.
Figure 13B:
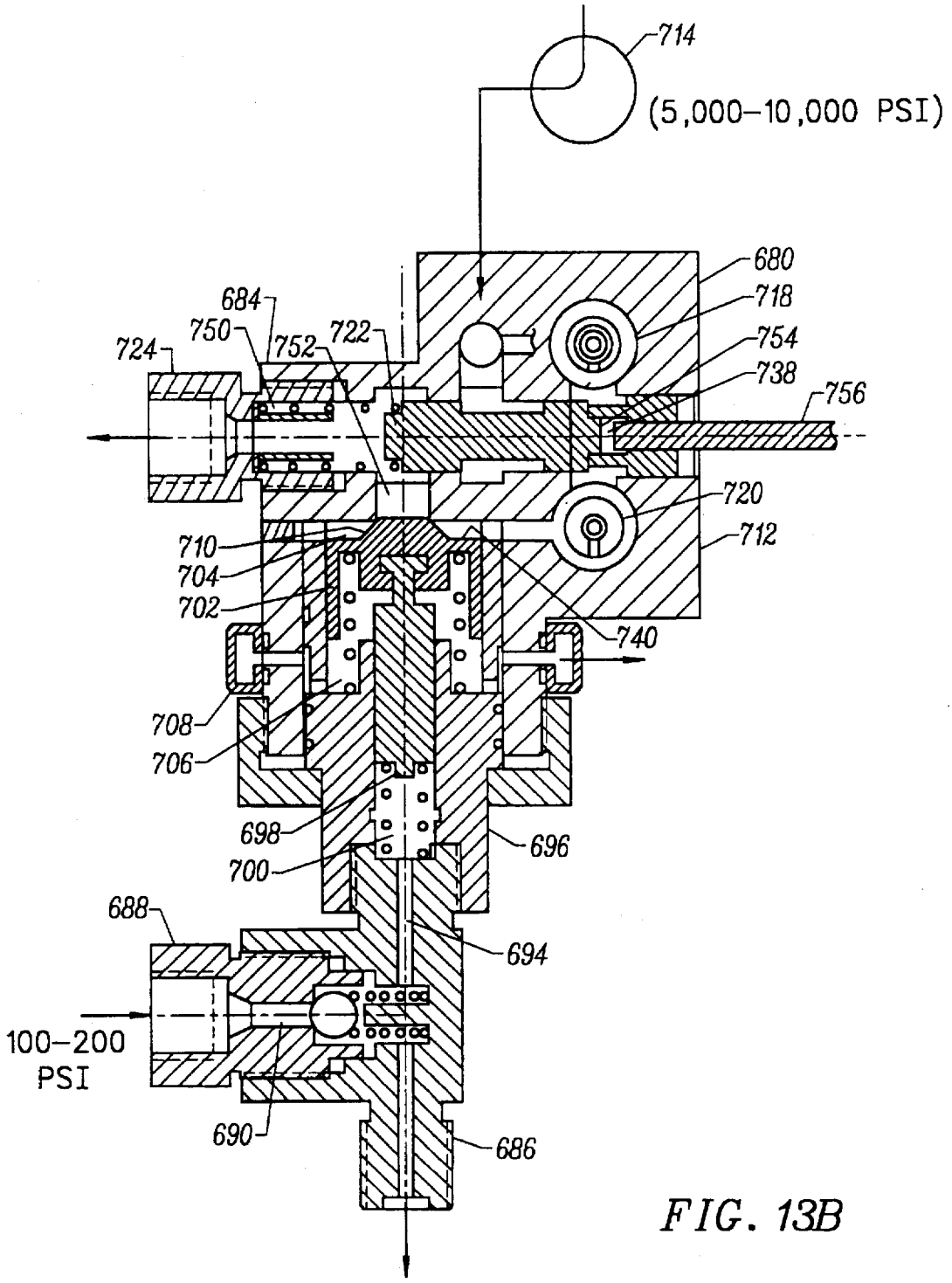
FIG. 13B is the side elevational view of the modular injector unit with the commuter valve in the closed position before and after injection.
Figure 14:
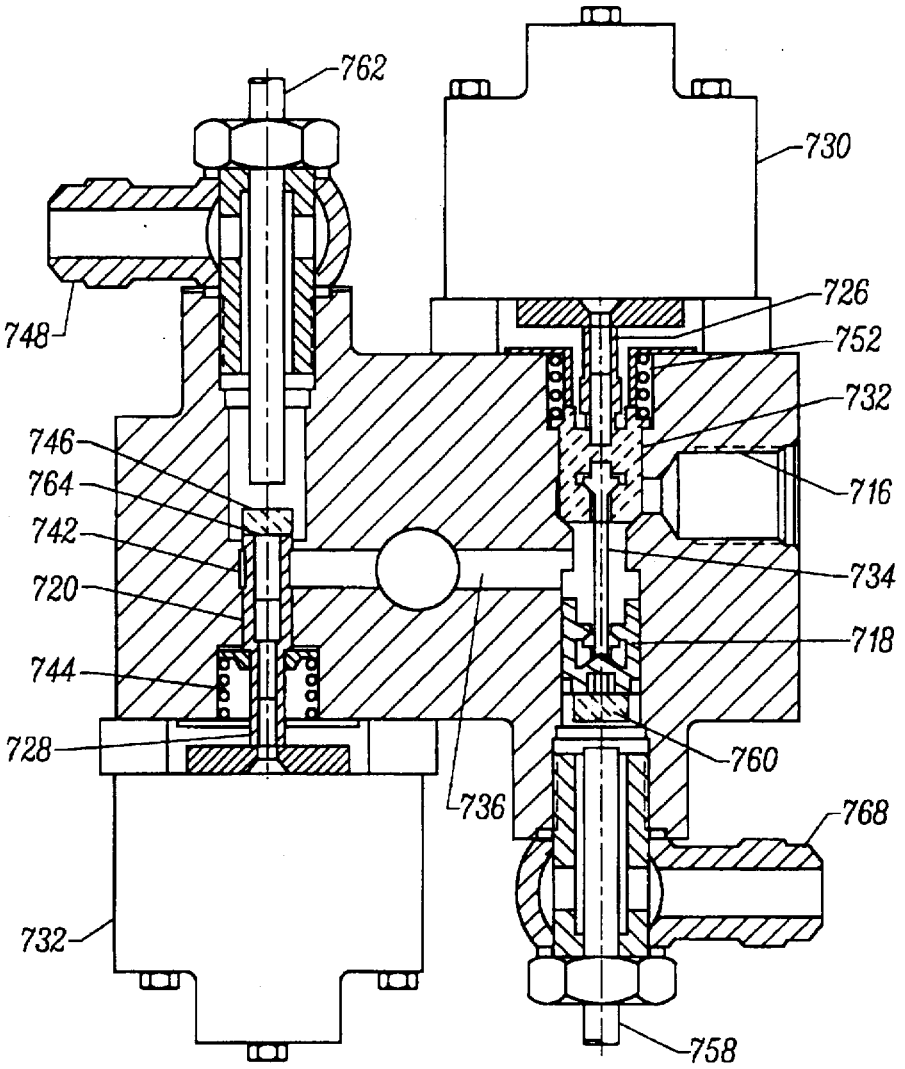
FIG. 14 is a cross sectional view taken on the lines 14—14 in FIG. 13A.

With no pressure on commuter valve spool 738, the spool displaces by action of the compression spring 750 to the relaxed position shown in FIG. 13B. This allows the main charge of hydraulic fluid to pass to the open discharge charge connector 724 for return to the low pressure supply when the amplifier piston 702 returns to its pre-injection position by force of the bias spring 706.

To provide direct feed-back control for timing activation and deactivation of the solenoid actuators 730 and 732, each of the spool valves 718, 720 and 722 is equipped with a position sensor. The proximity of an end magnet on valve spool 738 to commuter valve sensor 756 is continuously detected by the electronic control module 682. Similarly, an induction valve sensor 758 detects the proximity of an end magnet 760 on induction valve spool 732 and a discharge valve sensor 762 detects the proximity of an end magnet 764 on the discharge valve spool 742.

The real-time feed-back provided by the three injector control unit sensors allows instantaneous processing of operating condition for fuel pulse supply to the injector. When used with an injector having a similar feed-back sensor for the needle valve, precise control of each injector assembly is insured.

Figure 15:
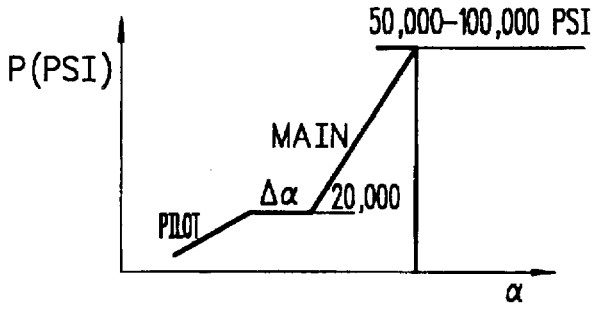
FIG. 15 is a diagrammatic illustration of the injector profile.

In operation, as shown in the diagrammatic illustration of FIG. 15, tight control of the rate of injection is possible with the arrangement of valves in the modular control unit providing the stepped pulse profile shown. The initial lower pressure pulse (approx. 20,000 p.s.i.) provides a pilot ignition flame close to the injector nozzle, and the follow-up high pressure pulse (approx. 30,000–100,000 p.s.i.) provides the deep penetration driving charge ignited from the pilot pulse, eliminating ignition delay and potential ignition knock. The cycle time that the commuter valve spool takes to move to open the main flow $\Delta\alpha$ provides the incremental delay for pilot ignition and main ignition.

Prior to initiation of injection, the induction valve 618 is closed isolating the control unit 680 from the pressurized hydraulic fluid. A double path is provided for hydraulic energy from pressurized fluid of the previous cycle to be relieved through the discharge connectors 724 and 748. Connector 768 allows for return of any fluid seeping past valve spool. The discharge valve 720 is preferably included to allow the discharge to halt before opening the induction valve eliminating loss of hydraulic energy occasioned in single valve systems.

Correlation of processed feed-back signals from the sensors are compared with mapped profiles for the operating conditions and provide for real-time correction of the next cycle of operation by advance or delay of the electronic ignition signal or the termination signal.

The modular injector control unit is mounted on each injector and replaces the common rail. The modular injector control unit can be adopted to existing fuel injectors or preferably newly designed fuel injectors with the needle valve position feed-back sensor.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A fuel injector system with a plurality of fuel injector units, the injector system having electronically operated fuel delivery components for control of a fuel injection pulse to each injector unit comprising:

an electronic control network having an electronic control module with memory means for mapping a reference operating profile for each injector unit and processing means for processing electronic sensor signals and controlling the electronically operated fuel delivery components; wherein each fuel injector unit has a fuel injector component and a hydraulic distributor component having electronically controlled valve means for regulated delivery of fuel to the injector component; wherein the injector component has an injector nozzle with a discharge tip with discharge orifices, a compression spring and a hydraulically actuated needle valve displaceable in the injector nozzle against the closure force of the compressing spring, the needle valve having sensor means for tracking the displacement and position of the needle valve, the sensor means having a transducer element on the needle valve displaceable with the needle valve and a stationary transducer element in the injector nozzle arranged in relation to the transducer element on the needle valve wherein the sensor means generates a continuous feed-back control signal indicative of the displacement and position of the needle valve in each injector unit that is processed by the electronic control module, wherein displacement and position of the needle is indicative of fuel discharge through the discharge orifices; wherein the electronically controlled valve means of the hydraulic distributor component has a displaceable slide valve and an electronically controlled displacement means for displacing the slide valve, the displacement means having position sensor means for sensing the position of the slide valve and providing a signal indicative of such position to the electronic control module for processing; and wherein each distributor component has independently operated electronic displacement means for regulating the distributor component valve means by the electronic control module with discrete adjustment for each injector unit from the processing of the feed-back control signal from the sensor means of the needle valve and the sensor means of displacement means in each injector unit, in accordance with the reference operating profile for that unit.

2. The fuel injector system of claim 1 wherein the hydraulic distributor component has a first fluid circuit and the injector component has a second fluid circuit.

3. The fuel injector system of claim 1 wherein the electronic displacement means of each hydraulic distributor component comprises a solenoid assembly for controlling the valve means.

4. In a fuel injection system having at least one fuel injector, a modular injector control unit comprising:

a unit having a housing with connector means to connect the injector control unit to a fuel injector;

a variable volume piston chamber in the unit housing with a fuel passage to a fuel intake connector and a check valve in the passage between the intake connector and the piston chamber, the piston chamber having an output passage to the connector means for fuel flow to a connected fuel injector;

a high pressure injector piston in the variable volume piston chamber in the unit housing;

an amplifier chamber with an amplifier piston of larger diameter than the injection piston displaceable in the amplifier chamber, the amplifier piston having a front face and a backside, the backside connected to the injection piston for displacement of the injection piston with the amplifier piston;

a hydraulic fluid intake passage, at least one hydraulic discharge passage, and an internal passage communicating in part with the amplifier chamber in the unit housing, with a valve system selectively connecting the intake passage with the internal passage, a commuter valve displaceable by pressurized hydraulic fluid when the induction valve is actuated connecting the intake passage with the internal passage, wherein on displacement, the commuter valve blocks the discharge passage and opens a bypass passage to the amplifier chamber for stepped injection of fuel into a connected fuel injector wherein the actuatable induction valve has sensor means for sensing the position of the induction valve and generating a feed-back control signal for optimized operation of the modular injector control unit.

5. The modular injector control unit of claim 4 wherein the internal passage communicates with a perimeter portion of the front face of the amplifier piston and the bypass passage communicates with a central portion of the amplifier piston.

6. The modular injector control unit of claim 4 wherein the valve system includes an actuatable discharge valve and an alternate discharge passage, the discharge valve selectively connecting the internal passage to the alternate discharge passage.

7. The modular injector control unit of claim 6 wherein the induction valve and discharge valve are actuated by an electronic solenoid actuator.

8. The modular injector control unit of claim 6 wherein the discharge valve has a valve sensor means for sensing the position of the discharge valve and generating feed-back control signal for optimized operation of the modular injection control unit.

9. The modular injector control unit of claim 8 in combination with an electronic control module wherein the valve sensor means of the induction valve and the discharge valve are connected to the electronic control module wherein sensor signals are processed for controlled actuation of the electronic solenoid actuator.

10. The modular injector control unit of claim 4 wherein a plurality of injector control units are combined with a respective number of injectors, and electronic control means for select control of individual combinations of control unit and injector.

11. The fuel injector system of claim 1 wherein the electronically controlled valve means of the hydraulic distributor component has a first slide valve for initiating the delivery of fuel to the injector component and a second slide valve for terminating delivery of fuel to the injector component wherein each slide valve has independently operated displacement means with sensor means.

12. The modular injector control unit of claim 4 in combination with a fuel injector having a needle valve with sensor means for sensing the position of the needle valve.

13. The modular injector control unit of claim 8 in combination with a fuel injector having a needle valve with sensor means for sensing the position of the needle valve.

* * * * *